US007360858B2

(12) United States Patent
Hayamizu et al.

(10) Patent No.: US 7,360,858 B2
(45) Date of Patent: Apr. 22, 2008

(54) INK CARTRIDGE, DETECTION DEVICE FOR CARTRIDGE IDENTIFICATION AND INK LEVEL DETECTION, AND IMAGE FORMATION APPARATUS COMPRISING THEREOF

(75) Inventors: Kazuhiro Hayamizu, Aichi-ken (JP); Masatoshi Yamada, Aichi-ken (JP); Yukichi Sawaki, Nagoya (JP); Koji Akagi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 196 days.

(21) Appl. No.: 10/874,333

(22) Filed: Jun. 24, 2004

(65) Prior Publication Data

US 2005/0024454 A1 Feb. 3, 2005

(30) Foreign Application Priority Data

Jun. 30, 2003 (JP) ..... 2003-188187
Jun. 30, 2003 (JP) ..... 2003-188840
Jul. 1, 2003 (JP) ..... 2003-270198
Jul. 8, 2003 (JP) ..... 2003-193340

(51) Int. Cl.
*B41J 29/393* (2006.01)
*B41J 2/175* (2006.01)

(52) U.S. Cl. ..... 347/19; 347/86

(58) Field of Classification Search ..... 347/19, 347/49, 85, 86, 87, 7
See application file for complete search history.

(56) References Cited

U.S. PATENT DOCUMENTS 5,616,929 A * 4/1997 Hara ..... 250/573
5,844,580 A * 12/1998 Barinaga et al. ..... 347/7
5,997,121 A * 12/1999 Altfather et al. ..... 347/7
6,012,795 A 1/2000 Saito et al.
6,299,274 B1 10/2001 Bolash et al.
6,390,590 B1 5/2002 Hansburg
6,460,962 B1 * 10/2002 Dietl et al. ..... 347/19
6,469,962 B2 * 10/2002 Chu ..... 369/44.28
6,540,314 B1 * 4/2003 Sanada et al. ..... 347/7
6,616,255 B2 9/2003 Murakami et al.
6,767,075 B1 7/2004 Takada et al.
2004/0017448 A1 1/2004 Murakami et al.

FOREIGN PATENT DOCUMENTS

JP 5332812 12/1993
JP A-11-010910 1/1999
JP 11129498 5/1999
JP 11263025 9/1999
JP 2000108373 4/2000
JP A-2000-263806 9/2000

(Continued)

*Primary Examiner*—Anh T. N. Vo
(74) *Attorney, Agent, or Firm*—Oliff & Berridge, PLC

(57) ABSTRACT

The ink cartridge has a first detection target portion for detecting ink level and a second detection target portion for identifying the type of an ink cartridge. The ink level detection device uses an optical sensor to scan the first and second detection target portions of the ink cartridge, and detects ink level and the type of the ink cartridge, that is, whether the ink cartridge is containing standard amount of ink or large amount of ink. Therefore, the number of image formation on recording media can be estimated, and failure in image formation due to a shortage of ink in the middle of image formation can be inhibited.

23 Claims, 22 Drawing Sheets

FOREIGN PATENT DOCUMENTS

| | | |
|---|---|---|
| JP | A-2000-280487 | 10/2000 |
| JP | A-2000-326519 | 11/2000 |
| JP | 2001047638 | 2/2001 |
| JP | A-2001-246760 | 9/2001 |
| JP | 2001328273 | 11/2001 |
| JP | A-2002-172796 | 6/2002 |
| JP | A-2002-273899 | 9/2002 |
| JP | 2002292890 | 10/2002 |
| JP | 2002292893 | 10/2002 |

* cited by examiner

INK CARTRIDGE, DETECTION DEVICE FOR CARTRIDGE IDENTIFICATION AND INK LEVEL DETECTION, AND IMAGE FORMATION APPARATUS COMPRISING THEREOF

BACKGROUND OF THE INVENTION (1) Field of the Invention

This invention relates to an ink cartridge used for image forming apparatus such as a printer, a copier and a facsimile. This invention also relates to a detection device for identification of an ink cartridge, and to an image forming apparatus comprising the ink cartridge and the detection device.

(2) Background Art

Amongst conventional ink cartridges used for an inkjet recording apparatus, some of them are constituted to allow ink level detection by optical devices.

Generally, ink of this type of ink cartridge is reserved in a case having an optically transparent portion. Light is emitted from a light source to inside the case through the transparent portion. The amount of reflected light changes depending whether or not ink is remained in the ink cartridge. The presence of ink is detected by this system. Yoshiyama et al (Japanese Patent Publication No. 2002-292890), for example, discloses this type of ink cartridge In an ink level detection device for this type of ink cartridge, when there is plenty of ink reserved in an auxiliary ink reservoir of an ink cartridge, light emitted from a light emitter enters inside the ink cartridge, because the refractive index of the material constituting the ink cartridge and the refractive index of the ink are very close. Then the light is reflected toward a direction different from the direction toward a light receiver by a reflector disposed in the ink cartridge. Thus the amount of reflected light toward the light receiver is small.

When ink is not in the auxiliary ink reservoir, the light emitted from the light emitter is reflected between inside of an outer wall of the auxiliary ink reservoir and air (i.e. at a prism). The amount reflected light toward the light receiver, in this case, is large. As described above, the amount of reflected light from an ink cartridge changes depending whether or not ink is reserved therein, and the presence of ink is detected from the difference in the light amount by using a light receiver.

Recently, the consumption of ink has been increasing as more image formation is conducted by users on larger quantity of recording media. Ink cartridges containing large amount of ink have been on demand as a replacement for ink cartridges containing standard amount of ink, which is presently available, However, such type of ink cartridges are not yet attained and not supplied to the market.

SUMMARY OF THE INVENTION

From above reason, a device which can identify an ink cartridge containing standard amount and an ink cartridge containing larger amount were not in need, therefore, did not exist.

However, if ink cartridges containing large amount of ink should be provided to the market in order to meet the need of users, distinct identification of an ink cartridge containing standard amount and an ink cartridge containing large amount is required to be conducted. An error detection of ink amount can cause a failure in image formation due to a shortage of ink.

It is an object of the present invention to provide an ink cartridge for an inkjet recording apparatus with a detection device, having a portion which optically facilitates detection of the ink level in an ink cartridge and a portion which optically facilitates identification of the type of an ink cartridge. These portions make detection of ink level and identification of the type of an ink cartridge by a detection device possible. Error detection of ink level and failure in image formation can be inhibited by this kind of ink cartridge.

It is another object of the present invention to provide a detection device which can conduct identification of the type of an ink cartridge installed in an image formation apparatus as well as detection of ink level so as to inhibit a failure in image formation. It is still another object of the present invention to provide an image formation apparatus having this kind of detection device.

To attain these and other objects, the ink cartridge of the present invention is detachably installed in an image formation apparatus having a detection device, and able to reserve ink in a case. The ink cartridge comprises a first detection target portion wherein ink level in the case can be optically detected by the detection device, and a second detection target portion wherein the type of the ink cartridge can be identified by the detection device, both disposed on the case thereof.

According to the ink cartridge of the present invention, a first detection target portion for detecting ink level and a second detection target portion for identifying the type of an ink cartridge are disposed on the case, and detection of ink level and identification of the type of an ink cartridge can be efficiently conducted by one detection device. Error detection of ink level can be inhibited by this constitution, and hence failure of image formation can be prevented.

The first detection target portion for ink level detection and the second detection target portion for cartridge identification of the ink cartridge of the present invention are preferably aligned.

Consequently, ink level detection and cartridge identification can be conducted simply by moving the detection device in the direction of the alignment of the first and second detection target portions in relation to the ink cartridge, and changing detection position.

The first and second detection target portions of the above ink cartridge are preferably formed on the same surface of the case.

The above disposition of the first and second detection target portions can simplify the structure of an ink cartridge.

The first detection target portion for ink level detection preferably includes a reflection modifier wherein the state of reflection of light emitted from outside the case changes depending on the ink level in the case.

Accordingly, the detection device can easily detect the ink level in an ink cartridge by detecting the state of the reflected light from the first detection target portion.

Moreover, the case of the ink cartridge preferably comprises a first reflector having a flat portion unparallel to the surface where the first and second detection target portions are formed. When light is emitted in predetermined direction from outside the case to the reflection modifier, if the amount of remaining ink in the case is equal to or more than predetermined amount, the light can enter the case from the reflection modifier, and can be reflected at the first reflector to a direction opposite to a predetermined direction. If the amount of remaining ink in the case is less than the predetermined amount, the light can be reflected at the reflection modifier to the predetermined direction.

With the above constitution, the detection device detects small amount of reflected light, if the amount of remaining ink in the case is more than the predetermined amount, and detects large amount of reflected light, if the amount of remaining ink in the case is less than the predetermined amount. Therefore the detection device can detect the ink level in an ink cartridge very easily.

The second detection target portion for cartridge identification preferably comprises a second reflector wherein the state of reflection is constant irrelevant to the ink level of an ink cartridge.

The state of reflection is constant if the second reflector is disposed on the second detection target portion, but inconstant without the second reflector. Consequently, the type of an ink cartridge can be easily identified.

The reflectance of the second reflector is preferably higher than the reflectance of the reflection modifier in the state when the amount of remaining ink in the case is less than the predetermined amount.

Because of the higher reflectance of the second reflector, the detection device can easily detect the ink level in the ink cartridge and easily identify the type of the ink cartridge.

A reflective member of the above second reflector is preferably disposed on the surface of an ink cartridge.

Due to the reflective member of the second reflector disposed on the surface of the ink cartridge, the same type of case can be used for different types of ink cartridges initially containing different amount of ink. The cost for making various types of cases corresponding to the number of the type of ink cartridges, therefore, can be cut down.

The reflection modifier of the ink cartridge described above preferably includes a prism. The reflection modifier can be formed simultaneously with the case by injection molding.

The second detection target portion for cartridge identification described above is preferably able to set the state of reflection in at least two areas.

With above constitution, three or more types of ink cartridges can be identified.

The detection device of the present invention is disposed in an image formation apparatus having a mounting portion that allows installation of an ink cartridge, and detects the ink level of an ink cartridge mounted on the mounting portion by using detection target portions disposed on the ink cartridge. Plural types of ink cartridges containing different initial amount of ink in the same color can be installed on the mounting portion. The detection target portions of the ink cartridge are constituted with first and second detection target portions. From the first detection target portion, it can be detected whether or not the amount of ink in the ink cartridge is equal to or more than reference amount. The reference amount is set to be less than the initial amount reserved in an ink cartridge containing the least of all the plural types of the ink cartridges. From the second detection target portion, the type of an ink cartridge can be identified. The detection device comprises a detector, a transporter, a determiner and an identifier. The detector optically detects the type of an ink cartridge installed on the mounting portion and whether or not the amount of ink in the ink cartridge is equal to or more than the reference amount by using the first and second detection target portions of the installed ink cartridge. The transporter moves detection position of the detector relative to the first and second detection target portions of the ink cartridge. The determiner determines whether or not the amount of ink in the ink cartridge installed on the mounting portion is equal to or more than the reference amount based on the result of an optical detection in the first detection target portion of the ink cartridge conducted by the detector at a first detection position which is a corresponding position to detect the first detection target portion. The identifier identifies the type of the ink cartridge installed on the mounting portion based on the result of an optical detection in the second detection target portion of the ink cartridge conducted by the detector at a second detection position which is a corresponding position to detect the second detection target portion.

According to the above-described detection device, both ink level detection and identification of the type of an ink cartridge installed on the mounting portion can be conducted with the simple structure of the detection device. Any type of ink cartridge amongst those containing different amount of ink therein can be identified, and a user can be aware of the type of the ink cartridge presently in use. The number of recording medium possible to from images thereon can be estimated. Therefore, failure in image formation caused by a shortage of ink in the middle of image formation can be inhibited.

The detector of the detection device preferably comprises a light emitter which emits light toward the detection target portions of the ink cartridge, and a light receiver which receives light reflected from the detection target portions. The identifier and the determiner of the detection device can identify the type of the ink cartridge and detect ink level based on the amount of light received by the light receiver.

With the detection device constituted as above, cartridge identification and ink level detection can be conducted based on the amount of light received by the light receiver, that is, data by which the determination process can be easily conducted.

Furthermore, the light receiver of the detector in the detection device preferably receives light emitted from the light emitter and reflected on the detection target portions.

Still furthermore, the detector of the detection device preferably conducts detection at plural detection positions for detecting both the first and second detection target portions.

The above-described detection device can prevent error detection of ink level in each detection target portion, and detect the ink level more accurately, in comparison with a detector of a detection device which conducts detection at only one detection position each for detecting the first and second detection target portions.

The identifier of the detection device preferably does not identify the type of an ink cartridge if the determiner determines that the amount of remaining inlk in the ink cartridge is less than the reference amount. This system can simplify the process.

The detector of the detection device can store light reception signals outputted from the light receiver when the position of the light emitted from the light emitter is changed from the first detection target portion to second detection target portion into a memory storage as light reception data. The identifier and determiner can conduct identification and ink level detection based on the light reception data stored in the memory storage.

By the above-described constitution, data storage into the memory storage and data determination are conducted separately since light reception signals of the first and second detection target portions disposed on the ink cartridge is stored as light reception data into the memory storage by the detector, and cartridge identification and ink level detection are conducted base on the stored light reception data by the identifier and the determiner. This constitution can make it possible to conduct a cartridge identification and ink level detection with the light reception data stored in the memory storage even if, for example, power cut occurs, or the image forming apparatus is switched off and restarted for some purpose in the middle of image formation.

The image formation apparatus of the present invention comprises a first ink level detector having the above-described detection device, and a second ink level detector which detects ink level based on the amount of image formation on recording media that has been conducted since the installation of the ink cartridge on the mounting portion. When an ink cartridge is installed on the mounting portion, the second ink level detector immediately sets the initial ink level of the ink cartridge in unused condition based on the type of the ink cartridge identified by the first ink level detector. Subsequently, the second ink level detector updates the ink level corresponding to the number of inkjets from the ink head. When the first ink level detector determines that the amount of ink in the ink cartridge has become less than the reference amount, the second ink level detector sets the ink level to a predetermined level corresponding to the reference amount. Then, the second ink level detector updates the ink level based on the number of inkjets from the ink head.

According to the image formation apparatus described above, a change in the initial ink level due to a change in the type of ink cartridge is reflected in display of the detection result. When the ink level is determined to be less than the level of the reference amount, ink level based on the initial ink level and the amount of image formation is set to the predetermined level corresponding to the reference amount, and updated according to the amount of ink actually jetted out from the ink head. Hence, ink level can be confirmed based on the amount of ink actually consumed, even if the amount of ink jetted out from the ink head in one time changes because of an environmental change, such as temperature. Accurate ink level detection can be conducted irrelevant to the environment.

The image formation apparatus preferably has a corrector which corrects at least the first detection position in relation to the ink cartridge installed on the mounting portion based on the result of detection at the first and second detection positions respectively corresponding to the first and second detection target portions.

The image formation apparatus constituted as above can correct the detection position/s (only the first detection position, or both of the first and second detection positions) based on the result of detection by the detector at the first and second detection positions.

Because a correction of detection positions is possible, it is not necessary to set the first and second detection positions precisely or arrange the detection target portions accurately, even if each area used for respective detection target portion is narrower than the area in the conventional structure wherein the second detection target portion is not disposed. Yet, error detection, e.g. the detector detects on a wrong detection target portion, can be inhibited.

For the above-described constitution, the time and work required to set and arrange the detection positions and the detection target portions accurately can be reduced. As a result, the manufacturing cost of the image formation apparatus or the ink cartridge can be cut down.

The corrector preferably sets a new boundary between the first and second detection positions, and corrects the first and second detection position based on the new boundary, if the amount of the light received by the light receiver of the detector changes more greatly than a predetermined level while the detector is moved by the transporter relatively so as to pass through the area including at least the first and second detection positions.

According to the image formation apparatus constituted as above, the following detection of one or both of the first and second detection target portion/s can be conducted more accurately.

One of the possible procedures of correction conducted by the corrector described above can be as follows: a position spaced out from the new boundary set as above for predetermined distance in a first direction which is the passage direction of the detector when the detector passes through the area including the first and second detection positions, is corrected as the first detection position; and a position spaced out from the boundary for predetermined distance in a second direction, which is the opposite direction to the first direction, is corrected as the second detection position.

In the image formation apparatus constituted as above, a position spaced out from the preset boundary for the predetermined distance in the first direction, which is along the passage direction, is set to be the first detection position, and a position spaced out from the preset boundary for the predetermined distance in the second direction opposite to the first direction is set to be the second detection position. By setting the predetermined distance from the preset boundary shorter than the width (the length along the passage direction) of the first detection target portion, the detector can detect the first detection target portion without failure. Moreover, by setting the predetermined distance from the preset boundary shorter than the width of the second detection target portion, the detector can detect the second detection target portion without fail.

The corrector can be arrange to set the first and second detection target portions as a new first detection target portion and correct the first detection position, if the amount of the light received by the light receiver of the detector does not change more greatly than the predetermined level, while the detector is moved by the transporter relatively so as to pass through the area including at least the first and second detection positions. This arrangement can enlarge the area of the first detection target portion, and correct the first detection position in a wider area for reliable detection. Thus, ink level detection can be more accurately conducted.

The present invention also provides an ink cartridge check program. This is a program for a computer system to conduct respective process for the determiner, identifier and corrector of the above-described image formation apparatus.

The above ink cartridge check program is constituted with sequences of commands respectively arranged to be suitable for computer processing. The check program is provided, for example, via a recording media, such as FD, CD-ROM or memory card, or communication network, such as Internet, to an image formation apparatus having this program installed therein, a computer system, or a user who uses the image formation apparatus and the computer system. In order to execute this ink cartridge check program, a computer system installed in an image formation apparatus, or a computer system connected via communication path with or without wire to a printer and capable of data communication, for example, can be used.

The present invention furthermore provides a correction method for detection positions. This correction method can be adopted to an image formation apparatus which comprises: a mounting portion capable of mounting an ink cartridge having a first detection target portion for determining whether or not the amount of the ink reserved in the ink cartridge is equal to or more than a reference amount, and a second detection target portion for identifying the type of the ink cartridge; and a detector optically capable of detecting the ink level in the ink cartridge and identifying the type of the ink cartridge by using the first and second detection target portions of the ink cartridge installed on the mounting portion, and which detects the ink level in the ink cartridge based on the result of detection in the first detection target portion and identifies the type of the ink cartridge installed on the mounting portion based on the result of detection in the second detection target portion. The detector of this kind of image forming apparatus is moved relative to the ink cartridge, and conducts detection at a first detection position predetermined to be able to detect the first detection target portion of the ink cartridge and at a second detection position predetermined to be able to detect the second detection target portion of the ink cartridge. Based on the result of the detection, at least one of the first and second detection positions relative to the ink cartridge installed on the mounting portion is/are corrected in this method.

BRIEF DESCRIPTION OF THE DRAWINGS

The invention will now be described below, by way of example, with reference to the accompanying drawings.

DETAILIED DESCRIPTION OF THE PREFERRED EMBODIMENT

The following describes an inkjet recording apparatus as an example of an image forming apparatus.

Figure 1:
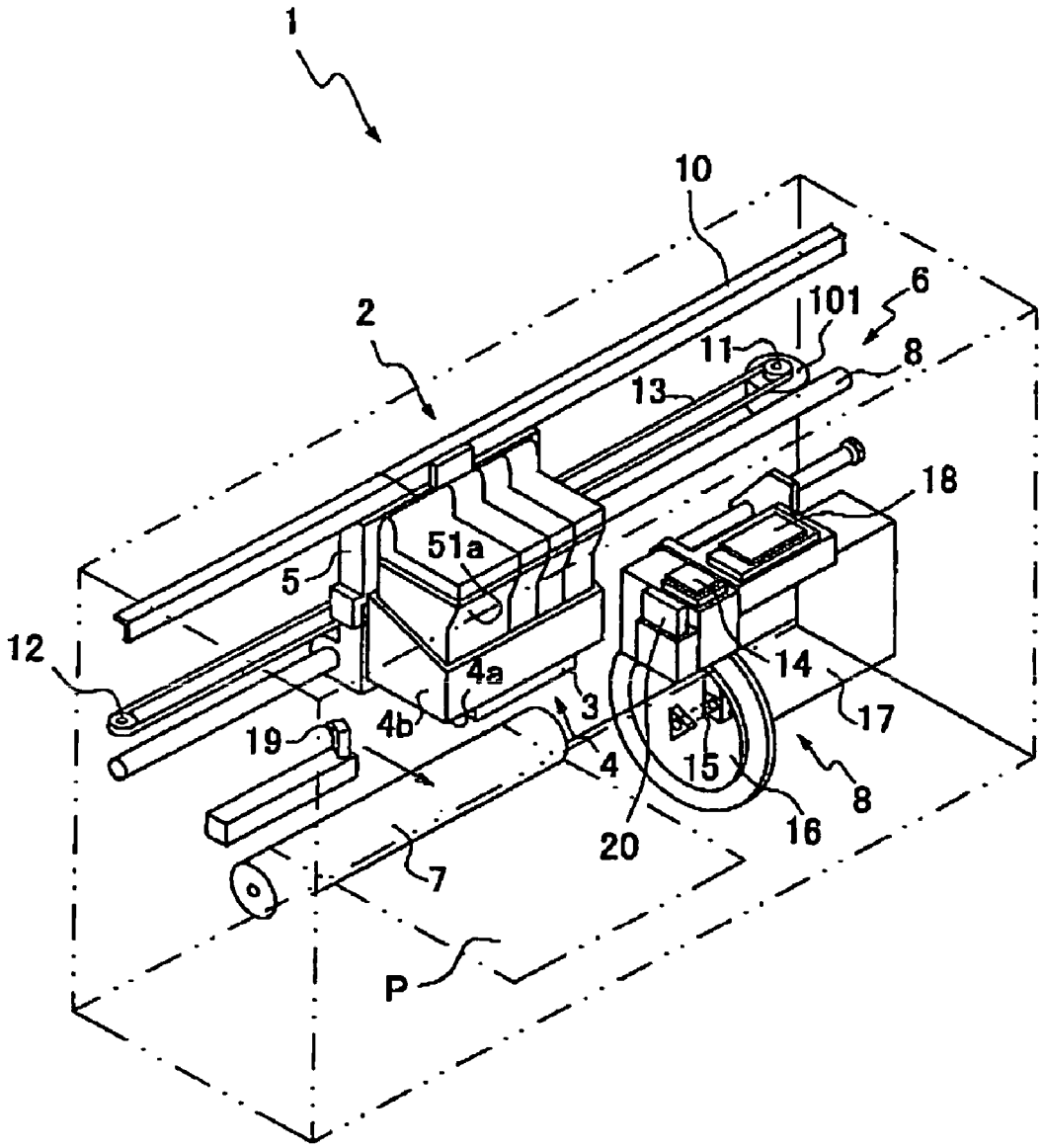
FIG. 1 is a perspective view illustrating the schematic structure of the inkjet recording apparatus of an embodiment according to the present invention.

Referring to FIG. 1, the inkjet recording apparatus 1 comprises a head unit 4 having a printing head 3 which is an ink head to form an image on a recording medium P such as paper, a carriage 5 mounting ink cartridges 2 and the head unit 4 thereon, a drive unit 6 which reciprocates the carriage 5 in a straight direction, a platen roller 7 extending in the direction of the reciprocating movement of the carriage 5 and facing the printing head 3, a purge unit 8 and an optical sensor 19 which serves as a detector (to be described later). In the present embodiment, the optical sensor 19 is fixed inside the inkjet recording apparatus 1. Three partitions (not shown) are disposed on a loading portion 4*a* of the head unit 4. Between a pair of side covers 4*b* formed on both sides of the loading portion 4*a*, the loading portion 4*a* is sectioned into four mounting portions by the partitions to mount ink cartridges 2.

The drive unit 6 comprises a carriage shaft 9 extending through the lower portion of the carriage 5 parallel to the platen roller 7, a guide bar 10 extending on the upper portion of the carriage 6 parallel to the carriage shaft 9, two pulleys 11 and 12 respectively disposed above each end of the carriage 9 between the carriage shaft 9 and the guide bar 10 and an endless belt 13 extended around the two pulleys 11 and 12.

When the pulley 11 is driven to rotate by a carriage motor 101 in the clockwise or the counterclockwise direction, corresponding to the rotational direction of the pulley 11, the carriage 5 attached to the endless belt 13 is reciprocated straight along with the carriage shaft 9 and the guide bar 10.

A recording medium P is fed from a feed tray (not shown) disposed on the side or in the lower portion of the inkjet recording apparatus 1 and introduced between the printing head 8 and the platen roller 7. Subsequently, a predetermined image is formed thereon by ink being discharged from the printing head 3, and ejected outside of the inkjet recording apparatus 1.

The purge unit 8 is disposed in one side of the platen roller 7 so as to face the printing head 3 when the head unit 4 is in a reset position. The purge unit 8 comprises a purge cap 14 abutting on openings of plural nozzles (not shown) of the printing head 3 to cover the openings, a pump 15, a cam 16 and an ink storage 17. When the head unit 4 is in the reset position, the nozzles of the printing head 3 are covered with the purge cap 14 and deteriorated ink mixed with air bubbles accumulated inside the printing head 3 is vacuumed by the pump 15 driven by the cam 16 in order to recover the printing head 3. The deteriorated ink vacuumed by the pump 15 is stored in the ink storage 17.

In one side of the purge unit 8 wherein the platen roller 7 is disposed, a wiper 20 is disposed adjacent to the purge unit 8. The wiper 20 is formed in the shape of a spatula. The wiper 20 wipes the nozzle surfaces of the printing head 3 while the carriage 5 is moving. A cap 18 covers the plural nozzles of the printing head a when the printing head 3 is back to the reset position after printing, so that ink does not get dried.

The optical sensor 19 is disposed in the ink-jet recording apparatus 1 in a manner so that light is emitted invertically to the exposure surface of the ink cartridge 2 in order to reduce noise signals (unnecessary reflected light) from an exposure surface of the ink cartridge 2. The inkjet recording apparatus 1 is configured to detect the ink level in the ink cartridge 2 and to identify the type of an ink cartridge 2 by comparing the amount of reflection detected by the optical sensor 19 with a threshold.

To be more particular, the optical sensor 19 is disposed in the vicinity of one end of the drive unit 6, that is, in the side of the drive unit 6 wherein the platen roller 7 is disposed. The optical sensor 19 faces the purge unit 8 across the platen roller 7. The optical sensor 19 comprises a light emitter 19*a* and a light receiver 19*b* (illustrated in FIG. 3). Light emitted from the light emitter 19*a* to an ink cartridge 2 is received as reflected light by the light receiver 19*b*. Based on the amount of the reflected light received by the light receiver 19*b*, the ink level in the ink cartridge 2 is detected and the type of an ink cartridge 2 is identified.

Figure 2:
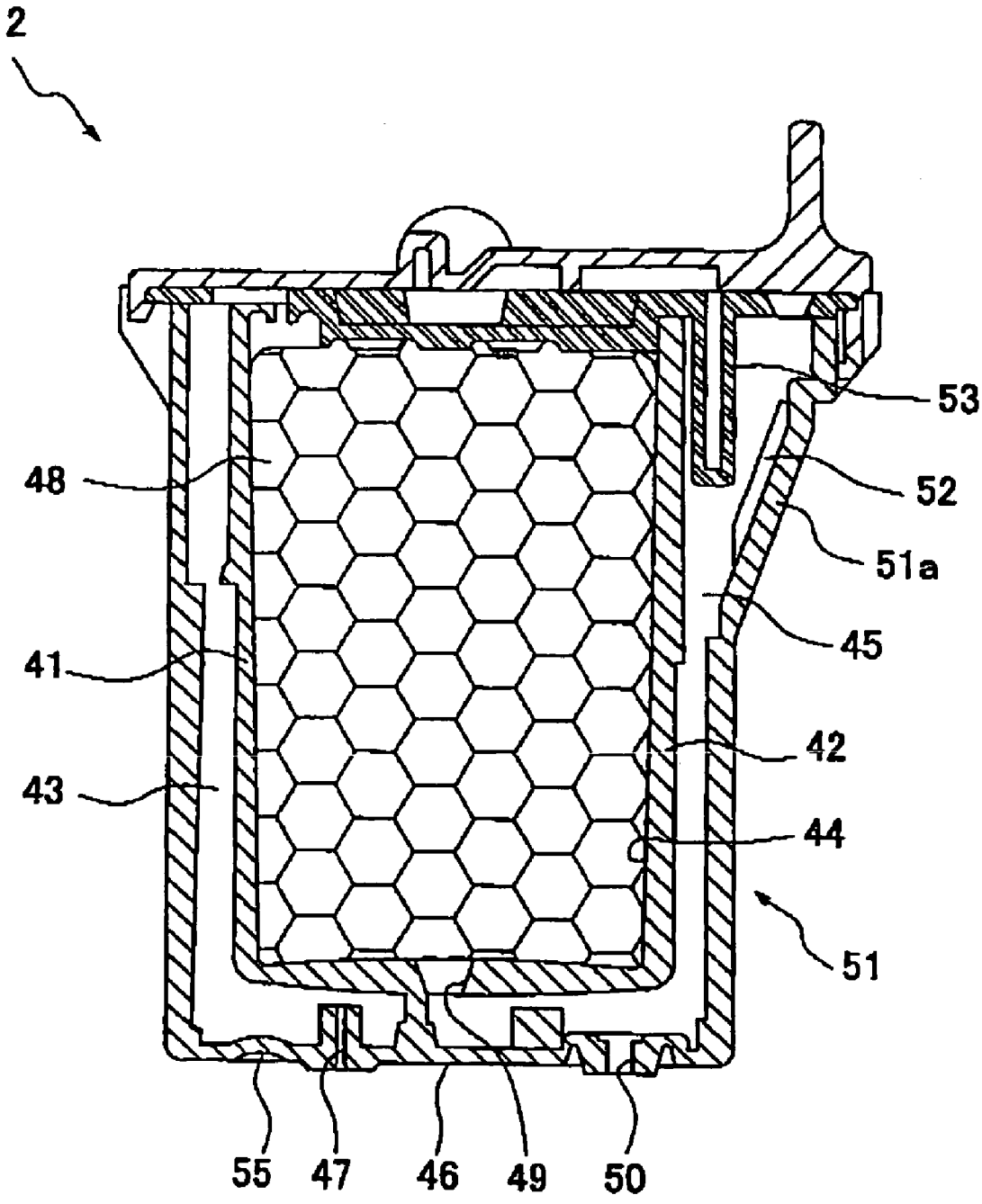
FIG. 2 is a sectional side view of an ink cartridge used in the inkjet recording apparatus shown in FIG. 1.

The followings describe the internal structure of the ink cartridge 2 with a reference to FIG. 2. FIG. 2 is a sectional side view of one ink cartridge 2 showing the ink cartridge 2 without ink reserved therein.

The ink cartridge 2 is formed in a box shape whose inside is almost hollow Inside of the ink cartridge 2 is sectioned into an air chamber 43, a main ink reservoir 44 and an auxiliary ink reservoir 45 by section walls 41 and 42. The air chamber 43 has a space to introduce atmospheric air into the main ink reservoir 44 and communicated with atmospheric air through an air slot 47 penetrating a bottom wall 46 of the ink cartridge 2. The upper portion of the air chamber 43 is communicated with the main ink reservoir 44. Atmospheric air is introduced into the main ink reservoir 44 through the communicated portion of the air chamber 43.

The main ink reservoir 44 has a sealed space in order to reserve ink and storing an ink absorbing foam (porous bodies) 48 wherein ink can be absorbed and retained. In the lower portion of the main ink reservoir 44, an ink slot 49 is formed penetrating the section wall 42. The main ink reservoir is communicated with the auxiliary ink reservoir 45 through the ink slot 49. The foam 48 is constituted with a sponge or fibrous material capable of retaining ink therein by the capillary phenomena. The foam 48 is compressed and stored in the main ink reservoir 44. This constitution inhibits ink from leaking out of the main ink reservoir 44 and entering air chamber 43 when, for example the ink cartridge 2 falls, and inhibits the ink entered the air chamber 43 from leaking outside of the ink cartridge 2 through the air slot 47.

The auxiliary ink reservoir 45 reserves ink, and comprises an inclined portion 51*a* to which light is emitted from the optical sensor 19. The auxiliary ink reservoir 45 is formed in one side of the ink cartridge 2 and formed as a substantially sealed space. The auxiliary ink reservoir 45 is communicated with the main ink reservoir 44 through the above-mentioned ink slot 49. The ink reserved in the main and auxiliary ink reservoirs 44 and 45 is supplied to the printing head 3 through an ink feed opening 50 penetrating the bottom wall 46 of the ink cartridge 2.

On the side wall 51 of the auxiliary ink reservoir 45, the inclined portion 51*a* is formed declining toward the main ink reservoir 44. Inside of the inclined portion (in the side of the main ink reservoir 44), a prism 52 (reflection modifier) is formed as a detection target portion which is to be described later. The prism 52 is used to detect the level of the ink reserved in the ink cartridge 2 and to identify the type of the ink cartridge 2. The prism 52 is integrally formed on the inclined portion 51*a* of the side wall 51 made of optically transmittable transparent material. In the upper portion of the auxiliary ink reservoir 45, there is a reflector 53 facing the prism 52 with predetermined interval in between. This reflector 53 is used to change an light path transmitted the auxiliary ink reservoir 45 and formed, with predetermined angle to the prism 52, in a pouch shape having air layers in the internal space therein.

According to an ink cartridge 2 configured as above, as ink is consumed by the printing head 3, depending on the amount of consumption, air is introduced into the main ink reservoir 44 from the air chamber 43, and the surface of the ink in the main ink reservoir goes down. As the ink is consumed further more and when the ink in the main ink reservoir 44 runs out, the ink in the auxiliary ink reservoir 45 is supplied to the printing head 3. When the ink in the auxiliary ink reservoir 45 is supplied, the pressure in the auxiliary ink reservoir 45 is reduced. However, as air is subsequently introduced to the auxiliary ink reservoir 45 from the air chamber 43 through the main ink reservoir 44, the air pressure reduction in the auxiliary ink reservoir 45 is eased and the ink surface in the auxiliary reservoir 45 goes down.

In the ink cartridge 2, the ink in the main ink reservoir 44 is firstly consumed. The ink in the auxiliary ink reservoir 45 is consumed after all the ink in the main ink reservoir 44 is used up. Hence, the ink level of the entire ink cartridge 2 can be detected by detecting the ink level in the auxiliary in reservoir 45 with using the optical sensor 19.

Figure 3A:
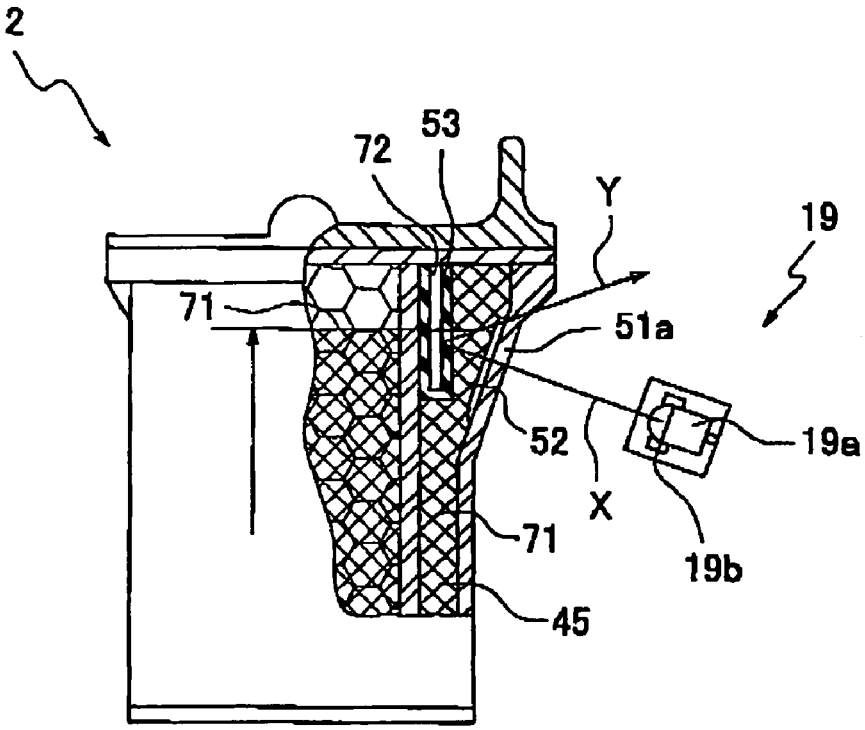
FIGS. 3A and 3B are side views of the ink cartridge and a sensor shown in FIG. 1.
Figure 3B:
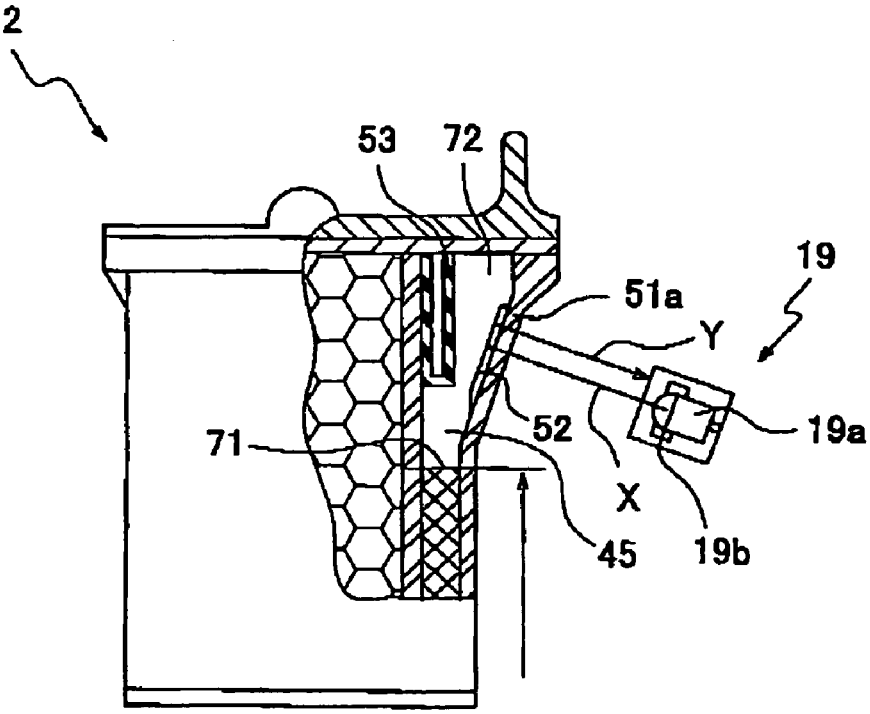

The following describes the principle of the ink level detection with a reference to FIGS. 3A and 3B. FIGS. 3A and 3B are side views of the ink cartridge 2 and the optical sensor 19 with cross sectional views of some part of the ink cartridge 2.

When there is plenty of ink 71 in the ink cartridge 2, as shown in FIG. 3A, light emitted from the light emitter 19*a* of the optical sensor 19 (light path X) transmits the ink 71 and proceeds in the ink cartridge 2 because the refractive index of the material forming the ink cartridge 2 and the refractive index of the ink 71 are extremely close. The light subsequently reaches the reflector 53 disposed in the auxiliary ink reservoir 45. Since the index of the material constituting the reflector 53 and the index of air 72 in the reflector 53 are different, the light reached the reflector 53 reflects on the boundary surface of the internal surface of the reflector 53 and the air 72 (light path Y).

On the other hand, when only small amount of the ink 71 remains in the auxiliary ink reservoir 45 in the ink cartridge 2, i.e. when the surface of the ink 71 is lower than the position of the prism 52 as shown in FIG. 3B, the light emitted from the light emitter 19*a* of the optical sensor 19 (light path X) reflects on the boundary surface of the internal surface of the reflector 53 and the air 72, i.e. on the prism 52 (light path Y), because the refractive index of the material constituting the ink cartridge 2 and the refractive index of the air 72 in the auxiliary ink reservoir 45 are different. Thus, the amount of the reflected light proceeding toward the light receiver 19*b* of the sensor 19 from the inside of the ink cartridge 2 is larger than the amount of the reflected light when there is plenty of ink 71 is in the ink cartridge 2.

As described above, the amount of the reflected light (light path Y) reflected from the ink cartridge 2 changes depending on the remaining amount of the ink 71. Therefore, by detecting the difference of the light amount with the light receiver 19*b* of the optical sensor 19, the ink level in the ink cartridge 2 can be detected.

The above-described structure wherein the amount of the remaining ink 71 is detected by the amount of the light emitted from the light emitter 19*a* of the optical sensor 19 to the inside of the auxiliary ink reservoir 45 and reflected therefrom constitutes a first ink level detector.

The status of the ink cartridge 2 being nearly empty (near-empty status) can be detected when the ink 71 does not exist in the upper portion of the auxiliary ink reservoir 45, that is, before the ink 71 runs out from the ink cartridge 2. This is because the inclined portion 51*a* and the reflector 58 are disposed in the upper portion of the auxiliary ink reservoir 45. When the surface of the ink 71 becomes lower than the position of the prism 52, the light receiver 19*b* of the optical sensor 19 receives a large amount of reflected light as described above. The amount of remaining ink 71 at this time is reference amount (to be described later) for the near-empty status of the ink cartridge 2.

As described above, the ink 71 is reserved in the main and the auxiliary ink reservoirs 44 and 45 of the ink cartridge 2 and supplied to the printing head 3. In the present embodiment, two types of ink cartridges are used. These ink cartridges initially reserve different amount of ink. To be more precise, the amount of ink 71 reserved in each auxiliary ink reservoir 45 is the same but the amount of ink 71 reserved in each main ink reservoir 44 is different. Depending on the amount of ink 71 in the main ink reservoirs 44, these two types of ink cartridges are distinguished between an ink cartridge 2A containing standard amount and an ink cartridge 2B containing large amount. Only the difference between these ink cartridges 2A and 2B is the amount of ink 71 reserved in the main ink reservoirs 44. The size and the shape of these ink cartridges are exactly the same and the ink cartridges 2A and 2B are alternatively mounted on the same place.

Figure 4A:
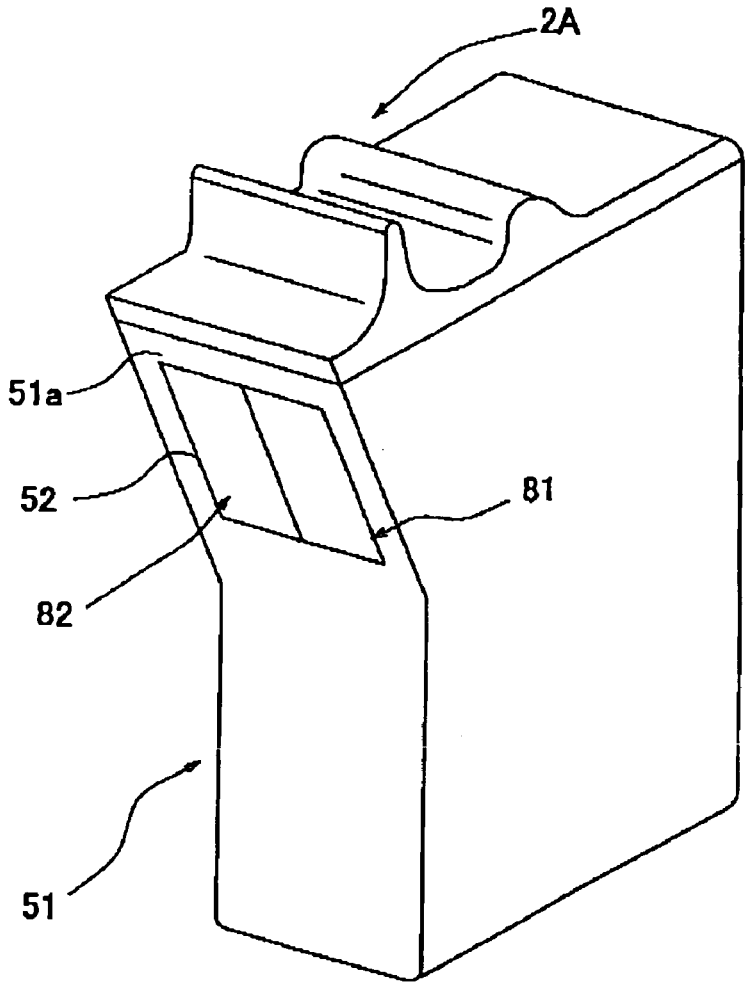
FIG. 4A is a perspective view of an ink cartridge containing standard amount of ink of the present invention.

FIG. 4A shows an ink cartridge 2A containing standard amount. The left half of the prism 52 is a first detection target portion 82 wherein the ink level in an ink cartridge 2 is optically detected whether or not the remaining amount of the ink 71 is more than the reference amount. The right half of the prism 52 formed on the inclined portion 51*a* of the side wall 51 is a second detection target portion 81 wherein the type of an ink cartridge 2 is optically identified.

The optical sensor 19 can optically detect the ink level in the ink cartridge 2A whether or not the amount of the ink 71 is more than the reference amount by using the first detection target portion 82 when the optical sensor 19 is moved relative to the ink cartridge 2A and positioned at a detection position corresponding to the first detection target portion 82. The optical sensor 19 can optically identify the type of the ink cartridge 2A by using the second detection target portion 81 when the sensor 19 is moved relative to the ink cartridge 2A and positioned at a detection position corresponding to the second detection target portion 81.

If there is plenty of ink 71 in the ink cartridge 2A, light emitted from the light emitter 19*a* of the optical sensor 19 to the first and the second detection target portions 82 and 81 transmits through the ink 71, proceeds in the ink cartridge 2A, and the light path thereof is changed by the reflector 53. Hence, the amount of the reflected light reflected toward the light receiver 19*b* becomes small.

Figure 4B:
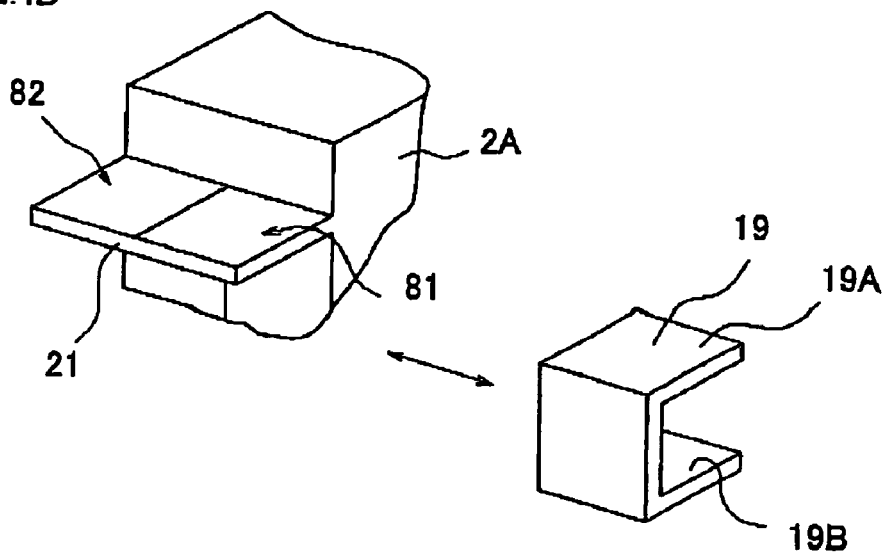
FIG. 4B is a partial perspective view of a variation of the ink cartridge containing standard amount.

FIG. 4B shows a variation of the ink cartridge 2A containing standard amount.

In this variation, a projecting portion 21 is formed instead of the inclined portion 51*a* on the ink cartridge 2A. In an anterior view, the left side of the projecting portion 21 is the first detection target portion 82 and the right side of the projecting portion 21 is the second detection target portion 81. In the projecting portion 21, a space is formed so as to communicate with the auxiliary ink reservoir 45 and ink can enter therein. When there is plenty of ink in the auxiliary ink reservoir 45, ink also exists in the space. When ink is consumed and the ink level in the auxiliary ink reservoir 45 becomes lower, ink does not exist in the projecting portion 21.

In this variation, the optical sensor 19 is formed almost in a "U" shape in profile. On an upper portion 19A and a lower portion 19B of the optical sensor 19, one of the light emitter 19*a* and the light receiver 19*b* is disposed 80 that one pair of the light emitter 19*a* and the light receiver 19*b* face each other. If the light emitter 19*a* is disposed on the upper portion 19A, the light receiver 19*b* is disposed on the lower portion 19B. This disposition can be vice versa. A detection of ink level and identification of the type of an ink cartridge 2 can be conducted, similarly to the above-described embodiment, when the projecting portion 21 of the ink cartridge 2A is moved relative to the optical sensor 19, as the arrows in FIG. 4B show, between the upper portion 19A and the lower portion 19B of the optical sensor 19, and the sensor 19 detects the amount of the transmitted light in the first and second detection target portions 82 and 81 respectively. In the detection of ink level and the identification of the type of an ink cartridge of this variation, the amount of the transmitted light is determined by three levels which is to be described in detail in the section referring to a variation of the ink cartridge 2B.

Figure 5A:
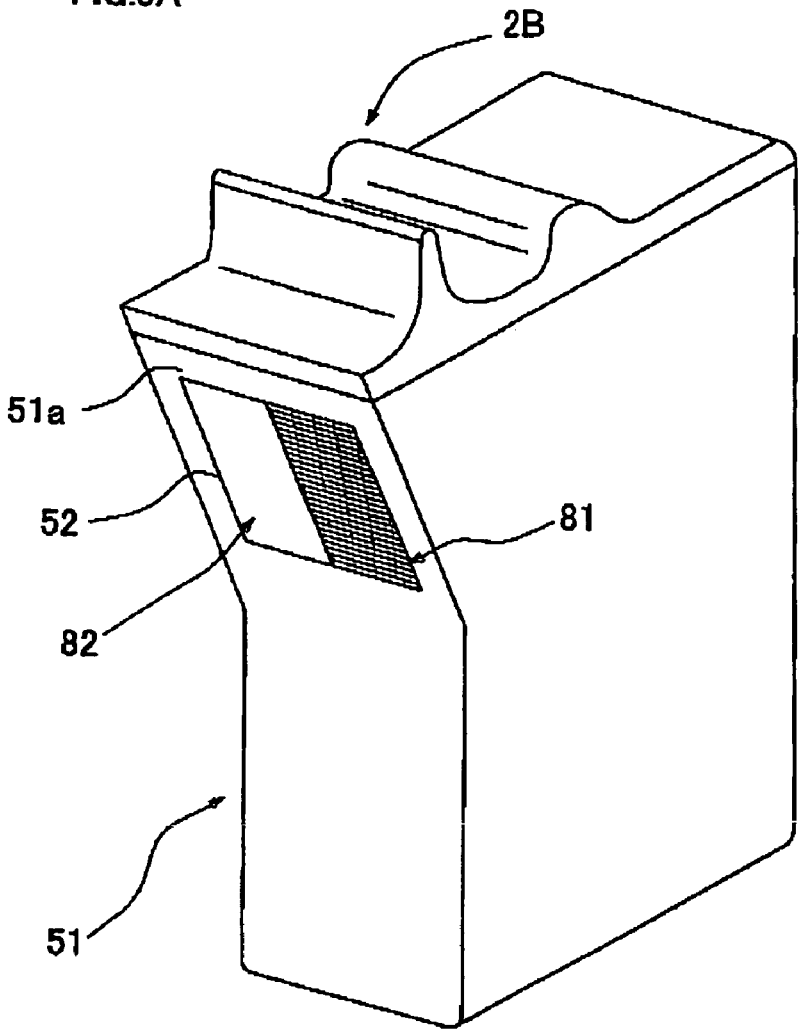
FIG. 5A is a perspective view of an ink cartridge containing large amount of the present invention.

FIG. 5A shows the ink cartridge 2B containing large amount. On the right half of the prism 52 formed on the inclined portion 51*a* of the side wall 51, an identification memeber such as aluminum foil 80 is disposed for identification of the type of an ink cartridge 2. The right half of the prism 52 is the second detection target portion 81 wherein the type of an ink cartridge 2 is optically identified. The left half of the prism 52 is the first detection target portion 82 wherein the ink level in an ink cartridge 2 is optically detected whether or not the amount of the ink 71 is more than the reference amount.

The aluminum foil 80 reflects light by the nature thereof when light is emitted from the light emitter 19*a* of the optical sensor 19 on the aluminum foil 80 disposed on the second detection target portion 81. The amount of reflected light reflected toward the light receiver 19*b* is much larger than the amount of reflected light reflected from the ink cartridge 2A on which the aluminum foil 80 is not disposed. By the difference in the amount of reflected light, the ink cartridge 2B containing large amount and the ink cartridge 2A containing standard amount can be identified. The appearance of the ink cartridge 2A mentioned above is the same as the appearance of the ink cartridge 2B, shown in FIG. 5A, except for the aluminum foil 80 disposed on the ink cartridge 2B.

When there is plenty of ink 71 reserved in the ink cartridge 2A containing standard amount, as explained above, the light emitted from the light emitter 19*a* of the optical sensor 19 is barely received by the light receiver 19*b*. Thus, the identification of the ink cartridges 2A and 2B can be reliably conducted by detecting the second detection target portion 81. However, when the amount of remaining ink 71 in the ink cartridge 2A is less than the reference amount (the ink cartridge 2A is in the near-empty status), the light receiver 19*b* receives a large amount of reflected light because the light emitted from the light emitter 19*a* is reflected on the prism 52 as described above. Accordingly, the amount of the light detected from the second detection target portion 81 of the ink cartridge 2B containing large amount and the amount of light detected from the second detection target portion 81 of the ink cartridge 2A containing standard amount by the optical sensor 19 are not distinctly different. Therefore, when the amount of the remaining ink 71 is less than the reference amount, identification of an ink cartridge 2 is not conducted. It is meaningless to identify an ink cartridge when the amount of remaining ink 71 becomes less than the reference amount, although the two types of ink cartridges 2A and 2B initially contain different amount of ink 71 when they are unused.

It is to be noted that if the aluminum foil 80 is disposed on the left half of the prism 52, the left half of the prism 52 becomes the second detection target portion 81 and the right half becomes the first detection target portion 82.

The carriage 5 is moved so that the detection position of the first detection portion 82 (on the prism 52) of the ink cartridge 2B faces the emitting direction of the light emitter 19*a* of the optical sensor 19. Then, light is emitted from the light emitter 19*a* of the optical sensor 19 to the prism 52 of the ink cartridge 2B presently mounted. The light receiver 19*b* receives the reflected light reflected on the prism 52, and ink level data is obtained depending on the difference in the amount of the reflected light and the data is stored to be determined whether or not the amount of the ink 71 in the ink cartridge 2B is equal to or more than the reference amount by a CPU 91 disposed in the ink-jet recording apparatus 1 (to be described later).

Subsequently, the carriage 5 is moved by a controller 90 (to be described later) disposed in the inkjet recording apparatus 1 so that the detection position of the second detection target portion 81 (the aluminum foil 80) of the ink cartridge 2B faces the emitting direction of the light emitter 19*a* of the optical sensor 19. Light is emitted from the light emitter 19*a* of the optical sensor 19 to the aluminum foil 80. Identification data is obtained from the amount of the reflected light reflected on the aluminum foil 80 and stored to be identified whether the ink cartridge 2 presently in use is the ink cartridge 2B or the ink cartridge 2A by the CPU 91 disposed in the ink jet recording apparatus 1 (to be described later).

The above constitution wherein the amount of the remaining ink 71 in a mounted ink cartridge 2 is determined whether or not to be equal to or more than the reference amount according to the amount of the reflected light on the prism 52 which is initially emitted from the light emitter 19*a* to the first detection target portion 82 (of the prism 52) serves as a determiner. Moreover, the constitution wherein the ink cartridge 2 presently in use is identified whether it is the ink cartridge 2B containing large amount or the ink cartridge 2A containing standard amount according to the amount of the reflected light on the prism 52 which is initially emitted from the light emitter 19*a* of the optical sensor 19 to the second detection target portion 81 (of the prism 52) serves as an identifier.

It is also possible to conduct the detection of the amount of the reflected light by moving the sensor 19 with a mover while the carriage 5 remains stationary.

Figure 5B:
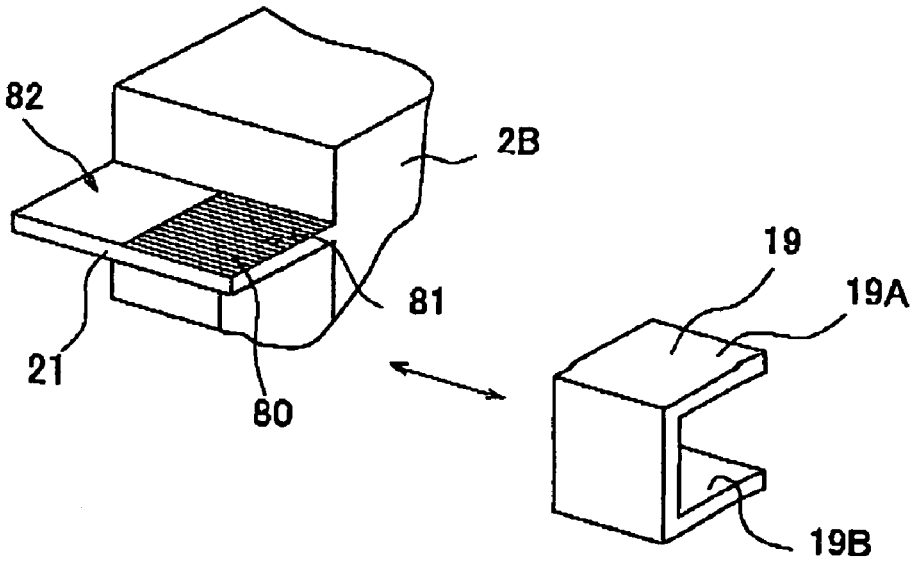
FIG. 5B is a partial perspective view of a variation of the ink cartridge containing large amount.

Referring now to FIG. 5B, a variation of the ink cartridge 2B containing large amount is illustrated therein.

In this variation, a projecting portion 21 is formed instead of the inclined portion 51*a* on the ink cartridge 2B. From an anterior view, the right side of the projecting portion 21 is the second detection target portion 81 and the left side of the projecting portion 21 is the first detection target portion 82. The aluminum foil 80 (identifier) is disposed on the second detection target portion 81 positioned on the right side of the projecting portion 21 of the ink cartridge 2B. In the projecting portion 21, a space is formed so as to communicate with the auxiliary ink reservoir 45 and ink can enter therein. When there is plenty of ink in the auxiliary ink reservoir 45, ink also exists in the space. When ink is consumed and the ink level in the auxiliary ink reservoir 45 becomes lower, ink does not exist in the projecting portion 21.

The optical sensor 19 is formed almost in a "U" shape in profile. On an upper portion 19A and a lower portion 19B of the optical sensor 19, one of the light emitter 19*a* and the light receiver 19*b* is disposed so that one pair of the light emitter 19*a* and the light receiver 19*b* face each other. If the light emitter 19*a* is disposed on the upper portion 19A, the light receiver 19*b* is disposed on the lower portion 19B. This disposition can be vice versa. The detection of ink level and the identification of the type of an ink cartridge 2 can be conducted, similarly to the above described embodiment, when the projecting portion 21 of the ink cartridge 2B is moved relative to the optical sensor 19, as the arrows in FIG. 5B show, between the upper portion 19A and the lower portion 19B of the optical sensor 19 and the optical sensor 19 detects the amount of the transmitted light in the first and second detection target portions 82 and 81 respectively. In the detection of ink level and the identification of the type of the ink cartridge of this variation, the amount of the transmitted light is determined by three levels. In other words, the amount of light received by the light receiver 19*b* differs in the following three cases: (1) the aluminum foil 80 (identification member) is disposed, (2) the aluminum foil 80 is not disposed and there is plenty of ink 71, and (3) the aluminum foil 80 is not disposed and there isn't much ink 71 left. In the first case, the light receiver 19*b* does not at all receive the light emitted by the light emitter 19*a*. In the second case, the light receiver 19*b* receives the half of the light emitted by the light emitter 19*a*. In the third case, the light receiver 19*b* receives most of the light emitted by the light emitter 19*a*. By determining the level of amount of the light received by the light receiver 19*b* from these three levels, the detection of the ink level and the identification of an ink cartridge 2 can be conducted similarly to the above-described embodiment.

In the present embodiment described above, the optical sensor 19 is fixed inside the inkjet recording apparatus 1.

The optical sensor 19 faces the first and the second detection target portions 82 and 81 of the ink cartridge 2 mounted on the carriage 5 when the carriage 5 is moved, and ink level data and identification data are obtained. Alternatively, this constitution can be arranged so that the carriage 5 mounting the ink cartridge 2B containing large amount is moved relative to the optical sensor 19 and the projecting portion 21 of the ink cartridge 2B goes through between the upper portion 19A and the lower portion 19B of the sensor 19. Or the optical sensor 19 can be configured to be movable by a mover and moves relative to the carriage 5 in stationary status so that the projecting portion 21 of the ink cartridge 2B mounted on the carriage 5 goes through between the upper portion 19A and the lower portion 19B of the optical sensor 19. In short, the projecting portion 21 should go through between the upper portion 19A and the lower portion 19B of the optical sensor 19.

The above describes that the second detection target portion 81 for identifying the type of an ink cartridge 2 is disposed on the right half of the inclined portion 51*a* in FIG. 5, and the first detection target portion 82 for detecting ink level in an ink cartridge 2 is disposed on the left half of the incline portion 51*a*. This disposition is arranged in consideration of the positions relative to the optical sensor 19.

Figure 6A:
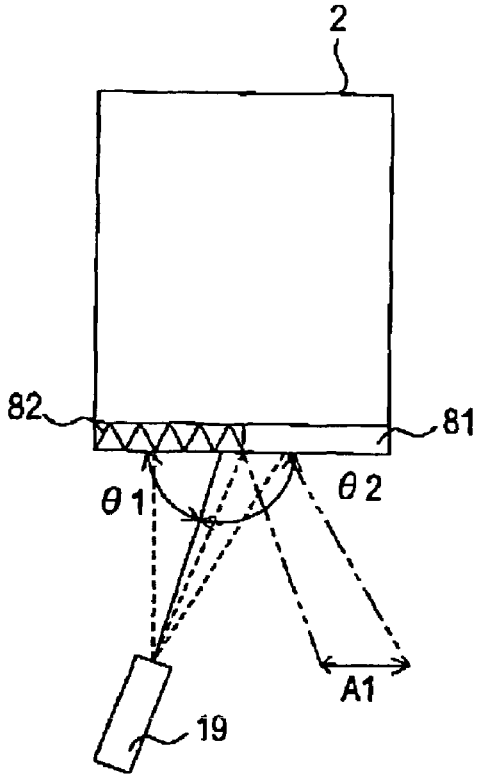
FIG. 6A is an explanatory view showing the positional relationship between an optical sensor and first and second detection target portions of an embodiment according to the present invention.

To be more precise, in this inkjet recording apparatus 1, the first and second detection target portions 82 and 81 are aligned in relation to the angles made by optical axis of the light emitted from the optical sensor 19 as shown in FIG. 6A. The first detection target portion 82 for detecting ink level is disposed in the side of the acute angle θ1, and the second detection target portion 81 for identifying the type of an ink cartridge 2 is disposed in the side of the obtuse angle θ2.

Since the light from the optical sensor 19 is emitted obliquely to the first and second detection target portions 82 and 81 as described above, the surface, on which these detection target portions 82 and 81 are disposed, can be divided into two parts: one part having the acute angle θ1 and the other having the obtuse angle θ2. In this embodiment, the detection target portion 82 for remaining amount of ink is disposed on the part having the acute angle θ1 and the detection target portion 81 for cartridge information is disposed on the other part having the obtuse angle θ2.

In other words, when the optical sensor 19 is scanning the first detection target portion 82 for detecting ink level, the second detection target portion 81 for identifying the type of an ink cartridge 2 is disposed away from the optical sensor 19, compared to the distance between the optical sensor 19 and the first detection target portion 82.

With this configuration of the first and second detection target portions 82 and 81, a false detection of the reflected light from the second detection target portion 81 by the optical sensor 19 does not occur while the optical sensor 19 is scanning the first detection target portion 82 for detecting ink level. This can inhibit the optical sensor 19 from detecting unnecessary light.

Figure 6B:
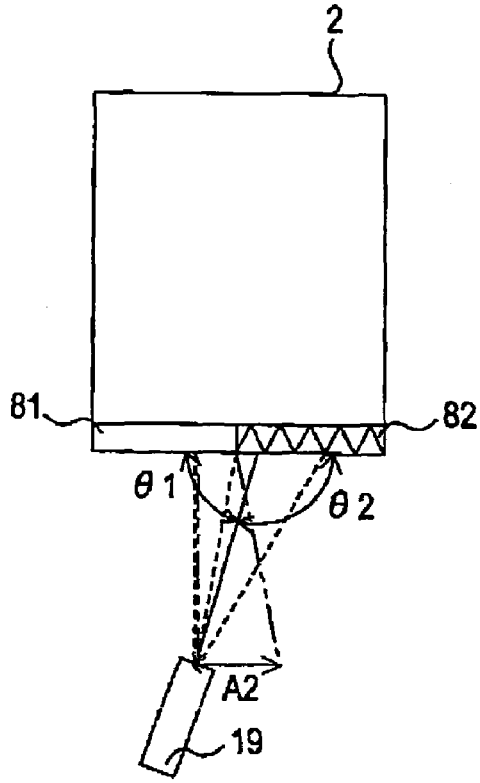
FIG. 6B is an explanatory view showing an comparative example.

If the second detection target portion 81 for identifying the type of an ink cartridge 2 is disposed on the part having the acute angle θ1 and the first detection target portion 82 for detecting ink level is disposed on the part having the obtuse angle θ2 as shown in FIG. 6B, the optical sensor 19 tends to detect the reflected light from the second detection target portion 81 falsely when the optical sensor 19 is scanning the first detection target portion 82 for detecting ink level because the second detection target portion 81 is disposed nearer to the optical sensor 19 than the first detection target portion 82.

Although the light emitted from the optical sensor 19 is suitably directive, the light is diffused in the vicinity (in the direction shown with dotted lines in FIGS. 6A to 6C) of the optical axis (shown in full line in FIGS. 6A to 6C) to certain degree. If the second detection target portion 81 for identifying the type of an ink cartridge 2 having high reflectance in the vicinity of the optical sensor 19 is disposed, the light reflected on the second detection target portion 81 can be detected in the areas A1 and A2 shown in the FIGS. 6A and 6B. The reflected light in the area A1 does not enter the optical sensor 19, but the reflected light in the area A2 does. The optical sensor 19 consequently detects this unnecessary light. Nearer the second detection target portion 81 for identifying the type of an ink cartridge 2 is disposed, the optical sensor 19 is more likely to receive the light diffracted at the second detection target portion 81. Hence, proximity of the absolute distance between the second detection target portion 81 for identification of an ink cartridge 2 and the optical sensor 19 while the optical sensor 19 is scanning the first detection target portion 82 for detecting ink level as shown in FIG. 6B is another factor to cause a false detection of unnecessary light.

Figure 7:
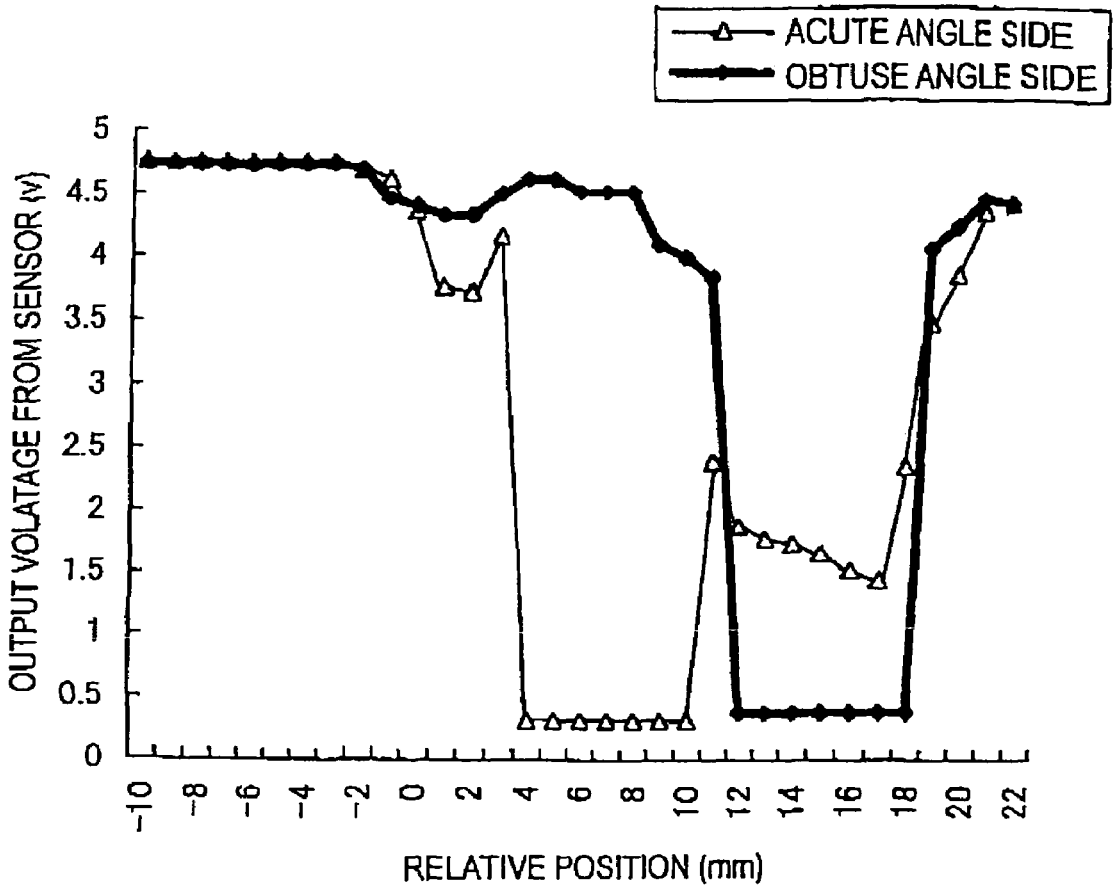
FIG. 7 is a line graph showing output voltage from the optical sensor disposed on the locations shown in FIGS. 6A and 6B.

FIG. 7 is a graph showing the result of measurements in the output voltage from the optical sensor 19 in two different cases: in case of disposing a reflective sticker 80 on the part with acute angle (referred to as acute angle side hereinafter), and on the part with obtuse angle (referred to as obtuse angle side). The horizontal scales of the graph indicate the relational position of the optical sensor 19 and the ink cartridge 2, and the vertical scales show the output voltage from the optical sensor 19. The output voltage from the optical sensor 19 is high when the optical sensor 19 is not detecting light, and low when the optical sensor 19 is detecting light.

In case the reflective sticker 80 is disposed on the acute angle side (refer to the line indicated as "acute angle side" in FIG. 7), when the optical sensor 19 initiates a scan on the reflective sticker 80 (the second detection target portion 81) corresponding to the change in the relational position of the optical sensor 19 and the ink cartridge 2, the output voltage from the optical sensor 19 drastically drops (in the vicinity of the relational position 4 to 10 mm in the graph). However, when the optical sensor 19 finishes the scan on the reflective sticker 80 (the second detection target portion 81) and subsequently initiates a scan on the prism 52 (the first detection target portion 82), the output voltage from the optical sensor 19 only increase up to 1.5 to 2.5 V (in the vicinity of the relational position 11 to 18 mm in the graph). This indicates that the output voltage from the optical sensor 19 does not sufficiently increases despite of the initiation of the scan on the prism 52 (the first detection target portion 82) because the optical sensor 19 is detecting unexpected reflected light. If a determination of ink level is attempted while the S/N ratio is low based on the amount reflected light from the prism 52, with relatively high threshold (for example, around 3V), it can be falsely determined that there is significant reflected light from the prism 52 (the first detection target portion 82) and that the ink cartridge 2 is in the near-empty status although the ink 71 is still remained therein. The threshold could be set relatively low (for example, around 1V) so that the reflected light from the prism 52 (the first detection target portion 82) is not determined to be significant. But, in this case, the significant reflected light sent to the optical sensor 19 when the ink cartridge 2 actually becomes nearly empty might not be determined existent, i.e. the ink cartridge 2 might be falsely determined not to be in the near-empty status even while the ink 71 is not remained therein.

To the contrary, in case the reflective sticker 80 is disposed on the obtuse angle side (refer to the line indicated as "obtuse angle side" in FIG. 7), when the optical sensor 19 initiates a scan on the prism 52 (the first detection target portion) corresponding to the change in the relational position of the optical sensor 19 and the ink cartridge 2, the output voltage from the optical sensor 19 is maintained very nigh (in the vicinity of the relational position 4 to 10 mm in the graph). After the optical sensor 19 finishes the scan on the prism 52 (the first detection target portion 82) and subsequently initiates a scan on the reflective sticker 80 (the second detection target portion 81), the output voltage from the optical sensor 19 drastically drops (in the vicinity of the relational position 12 to 18 mm in the graph). That is, the optical sensor 19 does not detect any unexpected reflected light while scanning the prism 52 (the first detection target portion 82) and the voltage outputted therefrom becomes sufficiently high. Under the condition where the S/N ratio is high, the existent of the significant reflected light from the prism 52 (the first detection target portion 82) and the near-empty status of the ink cartridge 2 can be correctly determined irrelevant to a slight variation in the output voltage from the optical sensor 19.

In this inkjet recording apparatus 1, the first detection target portion 82 for detecting ink level is set to be in a first reflection status wherein the reflectance thereof is lower than the reflectance of the second detection target portion 81 for identification when the amount of remained ink is equal to or more than predetermined amount. If the optical sensor 19 detects larger amount of light than the amount the optical sensor 19 detects in the first reflection status because of the reflected light from the second detection target portion 81, a false determination, i.e. the amount of remaining ink is determined to be less than the predetermined amount, can be made. However, the above disposition of the detection target portions 82 and 81 can inhibit a false detection caused by the reflected light from the second detection target portion 81, and the above-described false determination should not be caused.

In the examples given in FIGS. 6A and 6B, the first and second detection target portions 82 and 81 are aligned in the direction of the relative movement of the optical sensor 19 and the ink cartridge 2 and formed on the same surface. This and the above-described relational configuration of the optical sensor 19 and the first and second detection target portions 82 and 81 can effectively inhibit a detection of undesired light. It is also possible to adopt other configurations to inhibit a detection of undesired light if the first and second detection target portions 82 and 81 do not have to be formed on the same surface.

Figure 6C:
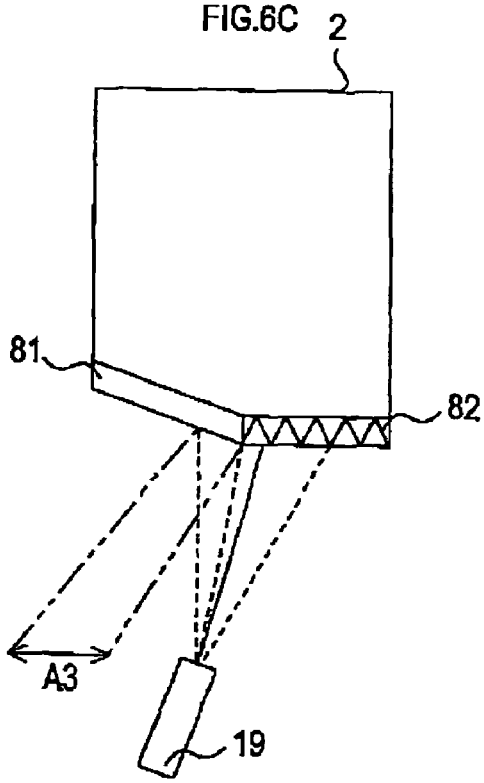
FIG. 6C is an explanatory view showing an variation of the present invention wherein fist and second detection target portions are not disposed on the same plane.

FIG. 6C shows an example of this kind of configuration. The second detection target portion 81 can be disposed with certain angle so as to deflect the light emitted from the optical sensor 19, when the optical sensor 19 is scanning the first detection target portion 82, by adjusting the angle of the second detection target portion 81 with a reference to the optical axis of the light from the optical sensor 19.

As described above, the light emitted from the optical sensor 19 is suitably directive and diffused in the vicinity (in the direction shown with dotted lines in FIG. 6C) of the optical axis (shown in full line in FIG. 6C). If the second detection target portion 81 having high reflectance in the vicinity of the optical sensor 19, the light reflected on the second detection target portion 81 is detected in the area A3 shown in FIG. 6C. By adjusting the angle of the second detection target portion 81 as shown in FIG. 6C, the area A3 can be moved away from the optical sensor 19 and a detection of unnecessary light can be inhibited.

Figure 8:
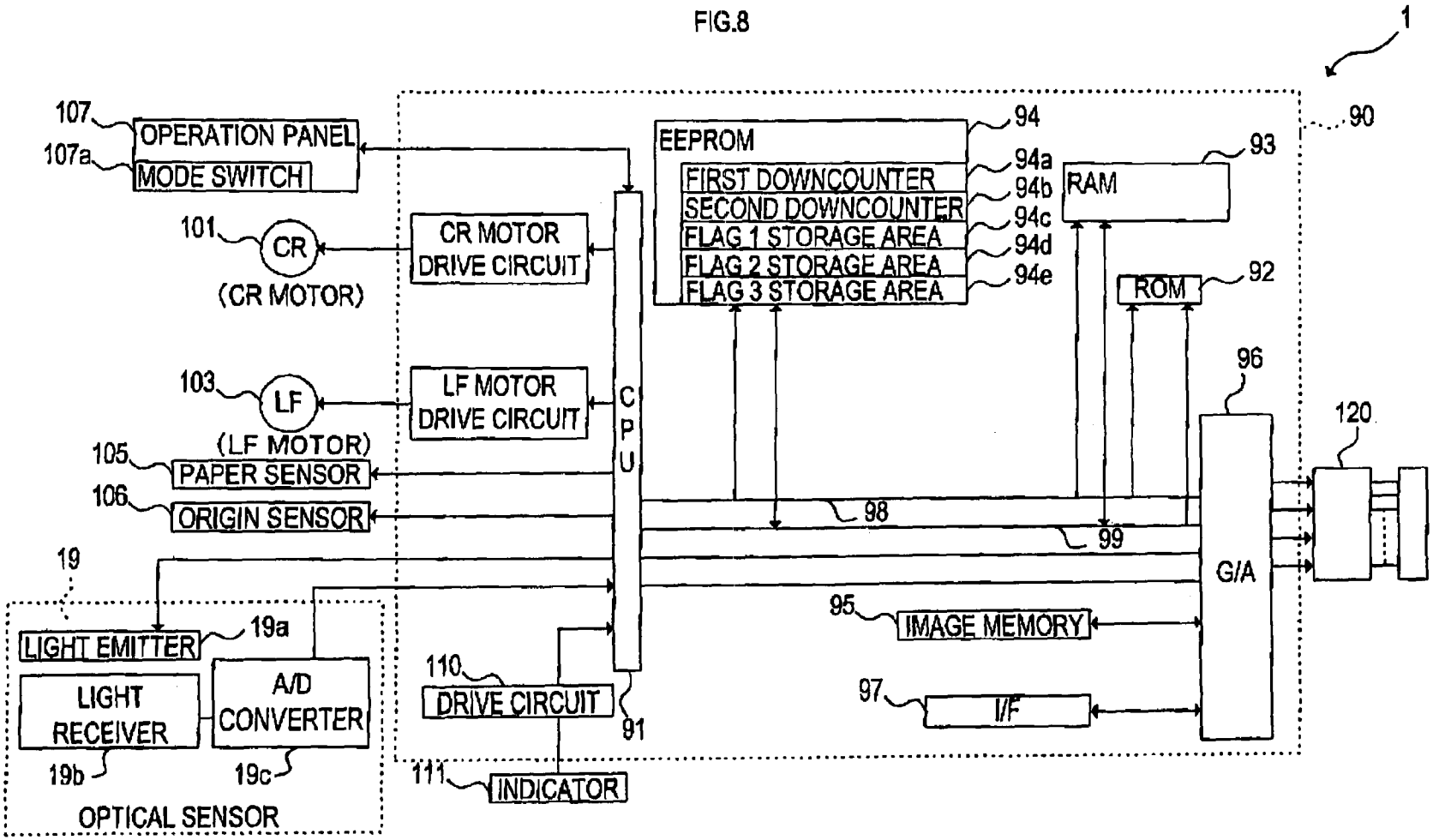
FIG. 8 a block diagram showing the schematic structure of the electric circuit in an inkjet recording apparatus of an embodiment according to the present invention.

Followings describe the structure of the electric circuit in the inkjet recording apparatus 1 with reference to FIG. 8. FIG. 8 a block diagram showing the schematic structure of the electric circuit in the inkjet recording apparatus 1.

The controller 90 which controls the inkjet recording apparatus 1 is equipped on a circuit board of the main body of the inkjet recording apparatus 1. The controller 90 comprises a micro computer (CPU) 91 consisting of one chip, a ROM 92 storing control programs which the CPU 91 conducts and data for fixed values, a RAM 93 which stores various data temporarily, an EEPROM 94 which is a writable nonvolatile memory, an image memory 95 and a gate array 96. The EEPROM 94 comprises a first downcounter 94*a*, a second downcounter 94*b*, a FLAG 1 storage area 94*c*, FLAG 2 storage area 94*d* and FLAG 3 storage area 94*e*.

In the FLAG 1 storage area 94*c*, near-empty flag (FLAG 1) is stored. The near-empty flag indicates that the ink cartridge 2 is nearly empty. "0" is stored in the FLAG 1 storage area 94*c* when the amount of the remaining ink 71 is more than the reference amount, and "1" is stored when the amount is less than the reference amount. In the FLAG 2 storage area 95*d*, cartridge replacement flag (FLAG 2) is stored. The cartridge replacement flag indicates whether or not the ink cartridge 2 is replaced. If the ink cartridge 2 is not replaced, the cartridge replacement flag indicates the type of the ink cartridge 2 presently mounted. "0" is stored in the FLAG 2 storage area 94*d* when the ink cartridge 2 is replaced, "1" is stored when the ink cartridge 2 is not replaced and the ink cartridge 2B containing large amount is presently mounted, and "2" is stored when the ink cartridge 2 is not replaced and the ink cartridge 2A containing standard amount is presently mounted. In the FLAG 8 storage area 94*e*, cartridge identification flag (FLAG 3) is stored. The cartridge identification flag indicates the type of the ink cartridge 2 presently mounted. "0" is stored in the FLAG 3 storage area 94*e* when the ink cartridge 2B containing large amount is presently mounted, and "1" is stored when the ink cartridge 2A containing standard amount is presently mounted.

According to the control programs stored in the ROM 92 in advance, the computing unit CPU 91 executes a control for detecting whether or not the ink 71 is in the ink cartridge 2. The CPU 91 also generates timing signals for image formation and reset signals and transfers the signals to the gate array 96 respectively. To the CPU 91, an operation panel 107 with which a user commands image formation, a motor drive circuit 102 which drives a carriage (CR) motor 101 to move the carriage 5, a motor drive circuit 104 which drives a line feed (LF) motor 103 which feeds a recording medium P, a paper sensor 105 which detects the leading edge of a recording medium P, an origin sensor 106 which detects the original position of the carriage 5, and the sensor 19 are connected. The movement of each device connected to the CPU 91 is controlled by the CPU 91. The aforementioned ROM 92, RAM 93, EEPROM 94 and the gate array 96 are connected to the CPU 91 via an address path 98 and a data path 99.

The following describes the first and the second downcounters 94*a* and 94*b* which serve as a second ink level detector.

Firstly, the second ink level detector having only one downcounter, i.e. the first downcounter 94*a*, is going to be described hereinafter.

The first downcounter 94*a* is disposed in the aforementioned EEPROM 94. The first downcounter 94*a* is a memory that counts the number of jets of the ink 71 from the printing head 3. For example, the first downcounter 94*a* subtracts "1" at every jet. The subtraction number can be variable depending on the size of ink drops if the size of ink drops jetted from the printing head 3 is changeable.

Predetermined amount of ink 71 is reserved, in the initial condition, respectively in the ink cartridges 2A and 2B. The maximum numbers of jetting with the amount of the ink 71 reserved in the ink cartridges 2A and 2B are respectively almost constant. When the ink cartridge 2 is replaced, the type of the ink cartridge 2 newly installed is identified by the optical sensor 19, and the maximum number of jetting corresponding to the amount of the ink 71 contained in the ink cartridge 2 newly installed is stored in the first downcounter 94*a*. Once jetting of the ink 71 is executed, the first downcounter 94*a* countdowns the number of jetting. Approximate amount of ink consumption is shown on an indicator 111 through a drive circuit 110 corresponding to the count. In this way, a user can know the approximate amount of remaining ink.

When the first ink level detector detects that the amount of the ink 71 in the ink cartridge 2 has become less than the reference amount (the near-empty status is detected), the ink level display on the indicator 111 is changed to a display showing the near-empty status. Subsequently, the number of jetting for the reference amount on the ink 71, that is, the maximum number of jetting in the near-empty status, is set in the first downcounter 94*a*. In other words, a detection of the near-empty status triggers setting the number of jetting for the reference amount of the ink 71.

As described above, the initial amount of the ink 71 reserved in the ink cartridge 2 is consumed first from the main ink reservoir 44. After the main ink reservoir 44 becomes empty, the ink 71 in the auxiliary ink reservoir 45 is used. When the surface of the ink 71 in the auxiliary ink reservoir 45 becomes lower than the bottom of the prism 52, as shown in FIG. 3B, the light emitted from the light emitter 19*a* of the optical sensor 19 is reflected by the prism 52 toward the light receiver 19*b* of the optical sensor 19 (light path Y). This changes (increases) the amount of the reflected light detected by the light receiver 19*b* of the optical sensor 19. As the amount of reflected light detected by the light receiver 19*b* is input in the CPU 91 in the form of signals, this change in the amount of the reflected light is recognized by the CPU 91 as the near-empty status and the corresponding near-empty flag (FLAG 1) is turned on. That is, "1" is stored in the FLAG 1 storage area of the EEPROM 94.

When the near-empty flag (FLAG 1) is turned on (the amount of ink 71 is detected to be less than the reference amount), the ink cartridge 2 is not yet actually empty. Thus image formation can be continued until the ink cartridge 2 becomes empty (the number of jetting reaches the empty threshold). When the maximum number of jetting in the near-empty status is set in the first downcounter 94*a*, countdown is conducted and the countdown number nears zero, the ink cartridge 2 becomes actually empty and "Replace ink cartridge" is indicated.

With references to the flowcharts in FIGS. 9 to 15 respectively, each process executed by the CPU 91 is described in below.

Figure 9:
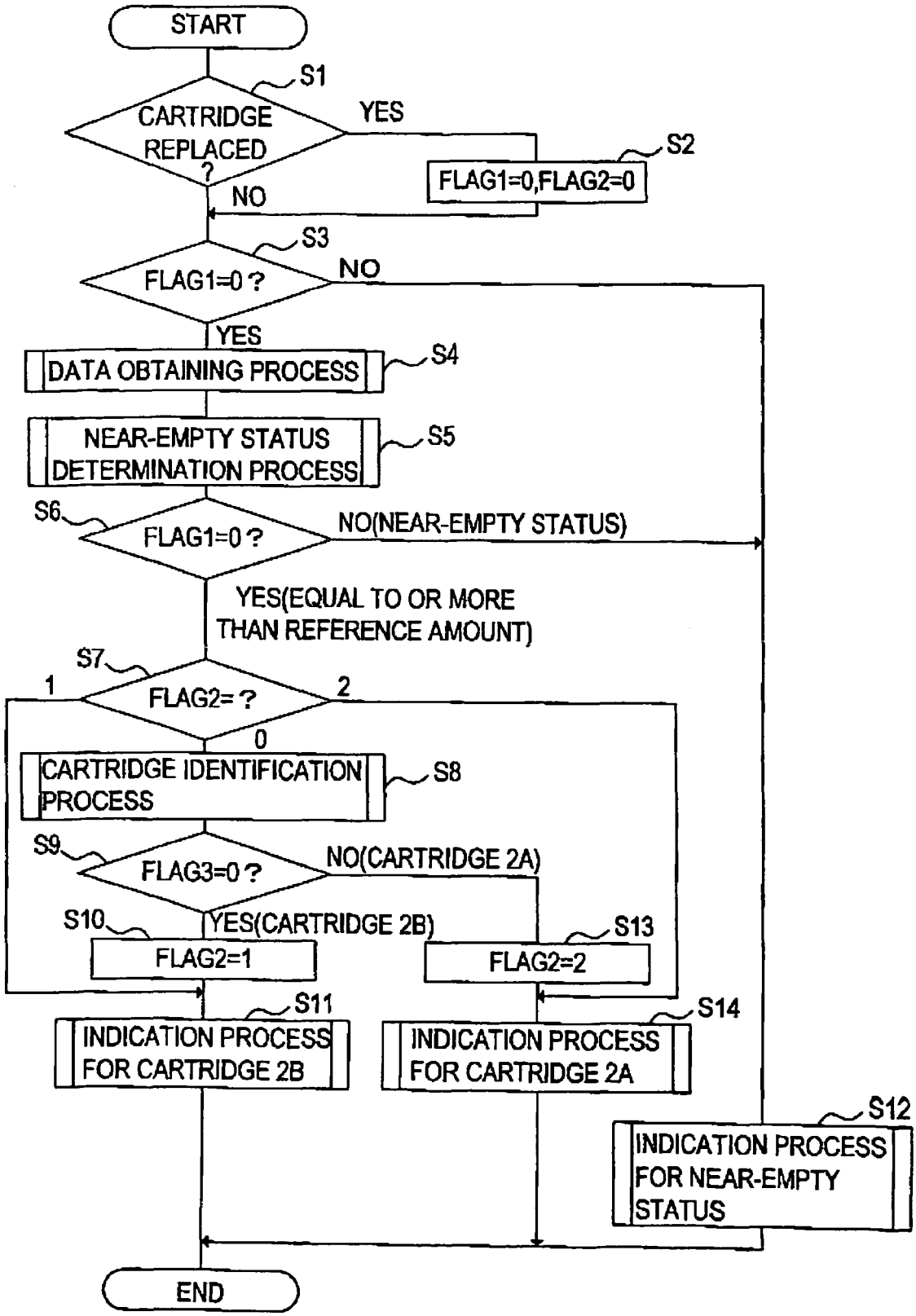
FIG. 9 is a flowchart showing an overall process executed by an inkjet recording apparatus of an embodiment according to the present invention.

FIG. 9 shows an overall process executed by the inkjet recording apparatus 1. This process is initiated while the power of the inkjet recording apparatus 1 is on, and either when a replacement button is pressed and opening/closing of a cover is detected or at every paper feed. In S1, it is determined whether or not the ink cartridge 2 is replaced. If the ink cartridge 2 is replaced (S1:YES), the near-empty flag (FLAG 1) is reset (FLAG 1=0) to indicate that there is plenty of ink 71 in the ink cartridge 2. Subsequently, the cartridge replacement flag (FLAG 2) is reset (FLAG 2=0) in S2. Then the process proceeds to S3. In this procedure, even if the ink cartridge 2 is not actually replaced, a cartridge replacement is determined to have been conducted provided that the power is on, the cartridge replacement button is pressed and opening/closing of the cover is detected.

In case the ink cartridge 2 is not replaced, e.g. though the cartridge replacement button is pressed, opening/closing of the cover is not detected within predetermined time (S1: NO), the process proceeds to S3 without S2.

In S3, it is determined whether or not the near-empty flag (FLAG 1)=0, i.e. whether or not "0" is stored in the FLAG 1 storage area of the EEPROM 94. This determination is conducted at this stage because the process can proceed to S12 wherein a process to indicate the near-empty status is conducted (to be described later) without conducting S4 wherein identification data and ink level data are obtained and stored if the ink cartridge 2 is not replaced (S1:NO) and FLAG 1=1 (already in the near-empty status) (S3:NO). In other words, when the near-empty status of the ink cartridge 2 is detected at this stage, the process can proceed to S12 which is a process for indicating the near-empty status without executing time-consuming S4.

On the other hand, if the near-empty flag (FLAG 1)=0, i.e. if there is plenty of ink 71 in the ink cartridge 2 (S3:YES), the process proceeds to S4.

Figure 10:
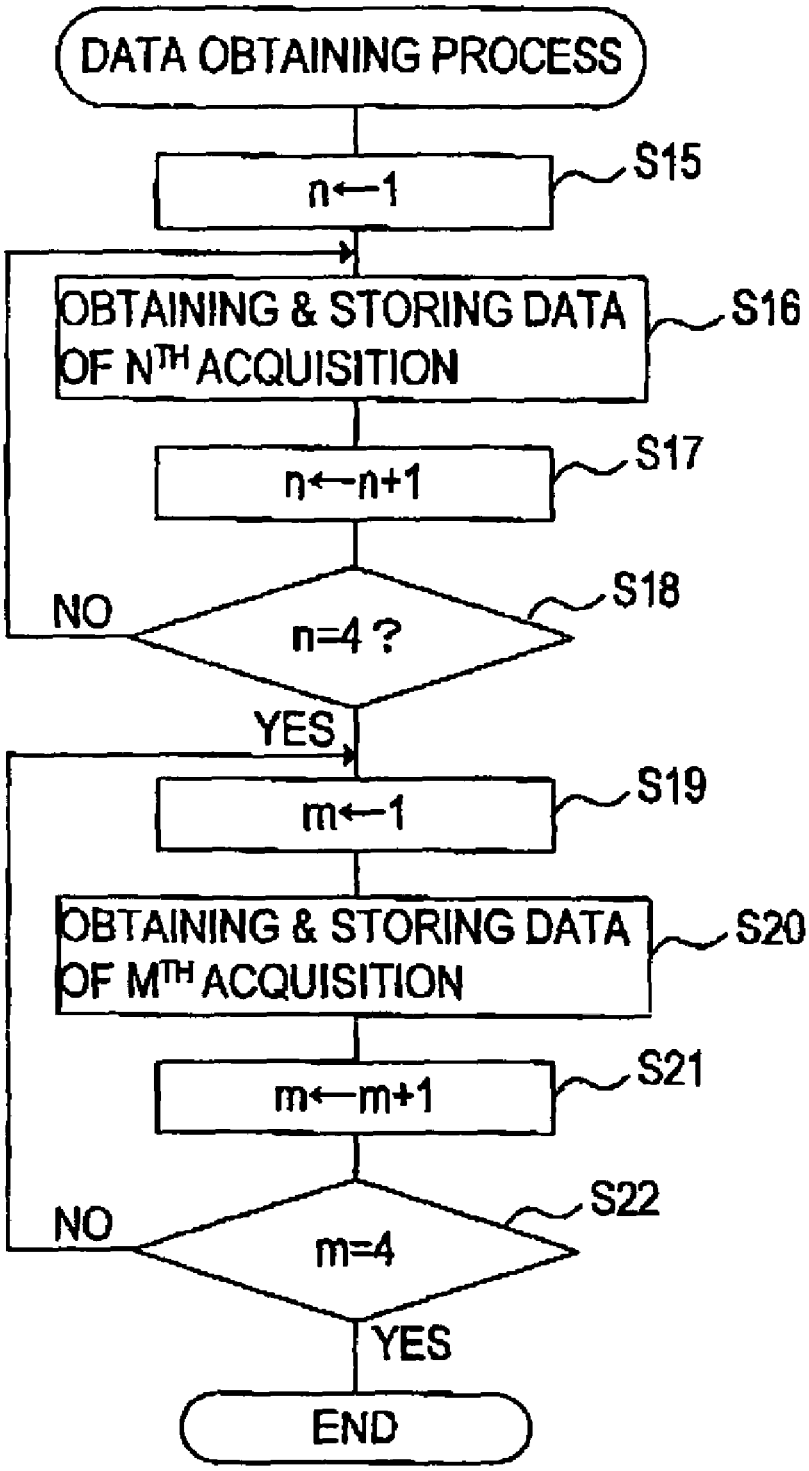
FIG. 10 is a flowchart showing data obtaining process executed in the overall process shown in FIG. 9.

In S4, process to obtain ink level data and identification data is executed by the optical sensor 19 in accordance with the flowchart shown in FIG. 10. It is to be noted that although the ink level data and identification data are obtained respectively three times in this flowchart, it can be any odd number of times, e.g. five times or seven times. Alternatively, it can be only one time in order to make the process easier.

In this data obtaining process, the CR motor 101 is firstly driven by the carriage motor drive circuit 102 to move the carriage 5 so that the first detection target portion 82 of the ink cartridge 2 faces the emitting direction of the light emitter 19*a* of the optical sensor 19. In the present embodiment, ink level data are obtained from three positions in the first detection target portion 82 and stored in the EEPROM 94. For "$n^{th}$" acquisition of ink level data, firstly "1" is stored in "n" storage area of the RAM 93 in S15. Then the carriage 5 is moved to the predetermined detection position for "$n^{th}$" data acquisition. Light is emitted from the light emitter 19*a* of the optical sensor 19 to the first detection target portion 82 (prism 52) of the installed ink cartridge 2. The light receiver 19*b* receives reflected light from the first detection target portion 82, converts the amount of reflected light into value of voltage and outputs the value. An A/D converter 19*c* compares the value of voltage outputted from the light receiver 19*b* with predetermined value and converts the value outputted from the light receiver 19*b* into "1" or "0". "1" is obtained when the value of voltage outputted from the light receiver 19*b* is higher than the predetermined value. "0" is obtained when the value of voltage outputted from the light receiver 19*b* is lower than the predetermined value. As described earlier, when there is plenty of ink 71 in the ink cartridge 2, the amount of reflected light from the first detection target portion 82 is small. The value of voltage outputted by the light receiver 19*b*, in this case, is high. The predetermined value of voltage is set to be lower than the value of high voltage outputted from the light receiver 19*b*. Therefore "1" is obtained for the ink level data. When the ink cartridge 2 is nearly empty, the amount of reflected light from the first detection target portion 82 is large. The value of voltage outputted by the light receiver 19*b*, in this case, is low. The predetermined value of voltage is set to be higher than the value of low voltage outputted from the light receiver 19*b*. Therefore "0" is obtained for the ink level data. The ink level data converted into "1" or "0" is stored in the EEPROM 94 in S16. After first acquisition of ink level data as above, "1" is added to the "n" stored in the "n" storage area in S17. In S18, it is determined whether or not n=4. If n=4 is not obtained (S18:NO), that is, if ink level data are not yet obtained from all the three positions in the first detection target portion 82, the process goes back to S16 for "$n^{th}$" acquisition of ink level data. If, on the other hand, n=4 (S18:YES), that is, ink level data have already been obtained from all the three positions in the first detection target portion 82 and stored in the EEPROM 94, the process proceeds to S19.

In the present embodiment, identification data are obtained from three positions in the second detection target portion 81 and stored in the EEPROM 94. For "$m^{th}$" acquisition of identification data, "1" is stored in "m" storage area of the RAM 93 in S19. Then the carriage 5 is moved to the predetermined detection position for "$m^{th}$" data acquisition. Light is emitted from the light emitter 19*a* of the optical sensor 19 to the second detection target portion 81 (the aluminum foil 80 or the prism 52) of the installed ink cartridge 2. The light receiver 19*b* receives reflected light from the second detection target portion 81, converts the amount of reflected light into value of voltage and outputs the value. An A/D converter 19*c* compares the value of voltage outputted from the light receiver 19*b* with predetermined value and converts the value outputted from the light receiver 19*b* into "1" or "0" is obtained when the value of voltage outputted from the light receiver 19*b* is higher than the predetermined value. "0" is obtained when the value of voltage outputted from the light receiver 19*b* is lower than the predetermined value. As described earlier, when the aluminum foil 80 is not disposed on the second detection target portion 81 and there is plenty of ink 71 in the ink cartridge 2, the amount of reflected light from the second detection target portion 81 is small. The value of voltage outputted by the light receiver 19*b*, in this case, is high. The predetermined value is set to be lower than the value of high voltage outputted from the light receiver 19*b*. Therefore "1" is obtained for the identification data. When the aluminum foil 80 is disposed on the second detection target portion 81 or the ink cartridge 2 is nearly empty while the aluminum foil 80 is not disposed on the second detection target portion 81, the amount of reflected light from the second detection target portion 81 is large. The value of voltage outputted by the light receiver 19*b*, in this case, is low. The predetermined value is set to be higher than the value of low voltage outputted from the light receiver 19*b*. Therefore "0" is obtained for the identification data. The identification data converted into "1" or "0" is stored in the EEPROM 94 in S20. After the first acquisition of identification data as above, "1" is added to the "m" stored in the "m" storage area in S21. In S22, it is determined whether or not m=4. If m=4 is not obtained (S22:NO), that is, if identification data are not yet obtained from all the three positions in the second detection target portion 81, the process goes back to S20 for "$m^{th}$" acquisition of identification data. If, on the other hand, m=4 (S22:YES), that is, identification data have already been obtained from all the three positions in the second detection target portion 81 and stored in the EEPROM 94, the data obtaining process is terminated and the process proceeds to S5.

Figure 11:
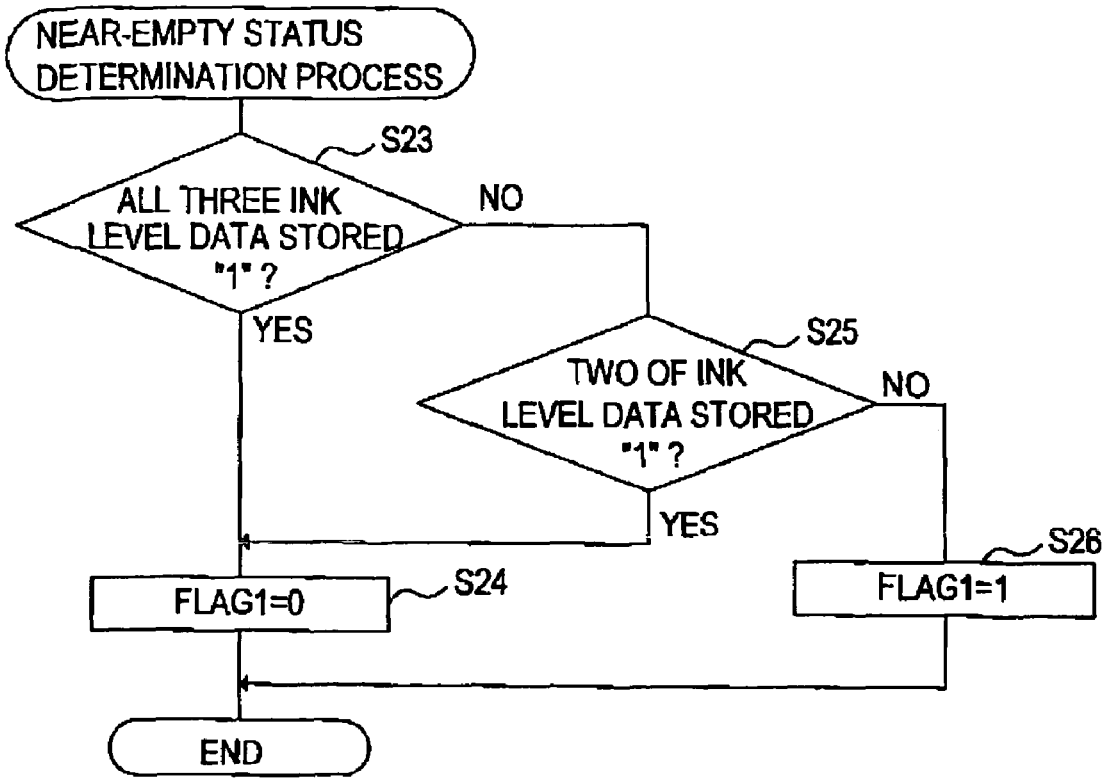
FIG. 11 is a flowchart showing near-empty status determination process executed in the overall process shown in FIG. 9.

In S5, near-empty status determination process is executed in accordance with the flowchart shown in FIG. 11 to determine whether or not the ink cartridge 2 is in a near-empty status.

In S23 of this near-empty status determination process, amongst the six data of ink level data and identification data stored in the EEPROM 94 in the data obtaining process (S4), three data related to ink level are read out and determined whether or not all the data are stored as "1". If all the data are stored as "1" (S23:YES), the near-empty flag (FLAG 1) is set to be "0" (FLAG 1=0) in S24. In other words, the amount of remaining ink 71 is determined to be plenty and the ink cartridge 2 is not in a near-empty status, "0" is stored in the FLAG 1 storage area 94*c* of the EEPROM 94, and the near-empty status determination process is terminated.

To the contrary, if not all the three data are stored as "1" (S23:NO), the process proceeds to S25 to determined whether or not two of the ink level data are stored as "1". This determination is made by a majority since the number of stored data is odd number. If two of the ink level data are stored as "1" (S25:YES), for example "1", "1" and "0", the process goes to S24. If two of the data are not stored as "1" (S25:NO), for example "1", "0" and "0", the near-empty flag (FLAG 1) is set to be "1" (FLAG 1=1) in S26. That is to say, the ink cartridge 2 is determined to be in a near-empty status, "1" is stored in the FLAG1 storage area 94*c* of the EEPROM 94 and the near-empty status determination process is terminated. This process of determining the near-empty status serves as a determiner.

After going through the near-empty status determination process, the process proceeds to S6. Similarly to S3, in S6, it is determined whether or not "0" is stored in the FLAG 1 storage area 94*c* of the EEPROM 94 (FLAG 1=0). This is to confirm the latest determination result from the near-empty status determination process in S5. If the ink cartridge 2 is in a near-empty status, i.e. the near-empty flag (FLAG 1)=1 (S6:NO), the process proceeds to S12 wherein the indication process for near-empty status is conducted. This (FLAG 1=1) is obtained only when the ink cartridge 2 is determined not to be in a near-empty status until immediately prior to S6, that is, when FLAG 1=0 is obtained in S5. In this case, the jetting number for the reference amount, i.e. the maximum number of jetting in the near-empty status, is set in the first downcounter 94*a*.

When the ink cartridge 2 is in a near-empty status (FLAG 1=0) respectively in S3 and S6, the process always proceeds to the indication process for near-empty status (S12) and cartridge identification process in S8 (to be described later) is not conducted. This is because identification of the ink cartridge 2, whether the ink cartridge 2 contains large amount or standard amount, becomes meaningless while the ink 71 in the ink cartridge 2 is running out.

If FLAG 1=0, i.e. there is plenty of the ink 71 in the ink cartridge 2 (S6:YES), the process proceeds to S7.

In S7, the value of the cartridge replacement flag (FLAG 2) stored in the FLAG 2 storage area 94*d* of the EEPROM 94 is determined either 0, 1 or 2. FLAG 2=0 indicates that the ink cartridge 2 has been replaced. FLAG 2=1 indicates that the ink cartridge 2 has not been replaced and the ink cartridge 2B containing large amount is presently installed. FLAG 2=2 indicates that the ink cartridge 2 has not been replaced and the ink cartridge 2A containing standard amount is presently installed.

Figure 12:
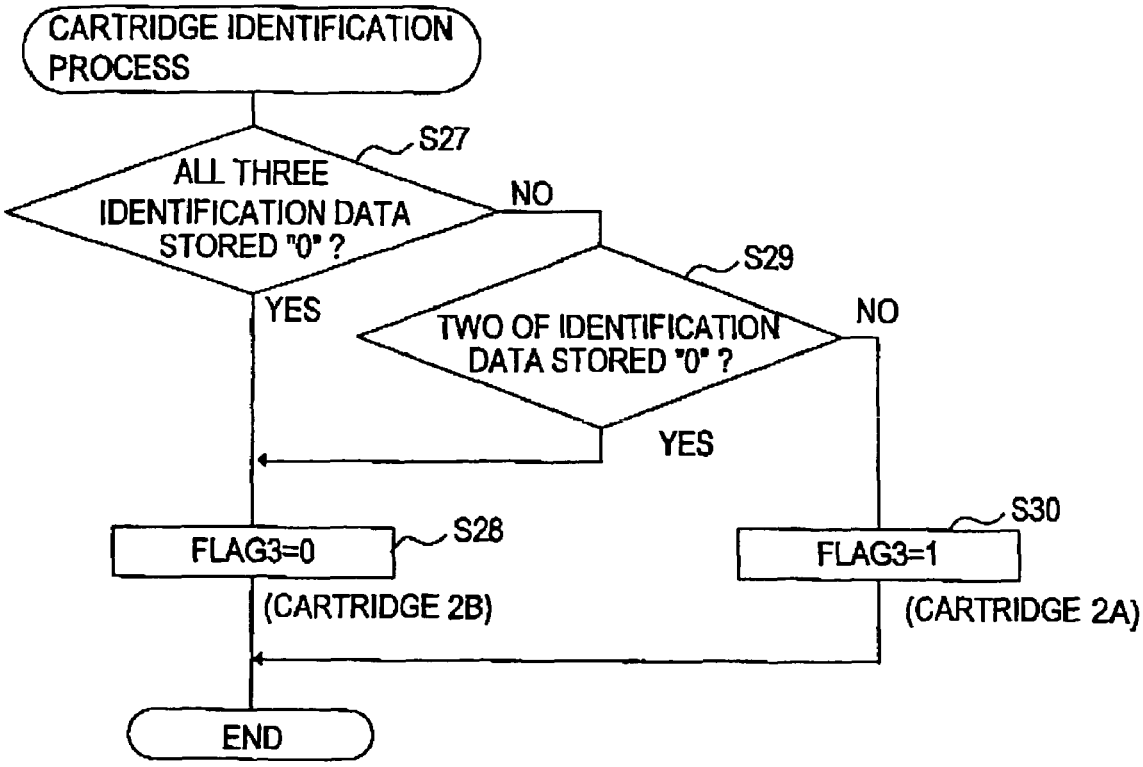
FIG. 12 is a flowchart showing cartridge identification process which is one of the control program executed in the overall process shown in FIG. 9.

If the ink cartridge 2 is replaced (S7:FLAG 2=0), the process proceeds to S8 and cartridge identification process is conducted to determine whether the ink cartridge 2 presently installed is the ink cartridge 2B containing large amount or the ink cartridge 2A containing standard amount, This identification process is executed in accordance with the flowchart in FIG. 12.

In this cartridge identification process (S27), amongst the six data of ink level data and identification data stored in the EEPROM 94 in the data obtaining process (S4), three data related to cartridge identification are read out and determined whether or not all the data are stored as "0". If all the data are stored as "0" (S27:YES), the cartridge identification flag (FLAG 3) is set to be "0" (FLAG 3=0) in S28. In other words, the newly replaced ink cartridge 2 is determined to be the ink cartridge 2B containing large amount, "0" is stored in the FLAG 3 storage area 94*e* of the EEPROM 94 and the cartridge identification process is terminated.

To the contrary, if not all the three data are stored as "0" (S27:NO), the process proceeds to S29 to determine whether or not two of the identification data are stored as "0". This determination is made by a majority since the number of stored data is odd number. If two of the identification data are stored as "0" (S29:YES), for example "0", "0" and "1", the process goes to S28. If two of the data are not stored as "0" (S29:NO), for example "1", "1" and "0", the cartridge identification flag (FLAG 3) is set to be "1" (FLAG 3=1) in S30. In other words, the ink cartridge 2 newly installed after a replacement is determined to be the ink cartridge 2A containing standard amount, "1" is stored in the FLAG 3 storage area 94*e* of the EEPROM 94 and the cartridge identification process is terminated. This process of cartridge identification serves as an identifier.

Subsequently to the termination of the cartridge identification process, the process proceeds to S9. In S9, it is determined whether "0" is stored in the FLAG 3 storage area 94*e* of the EEPROM 94, i.e. FLAG 3 (cartridge identification flag)=0. This is to confirm the identification result obtained in the cartridge identification process (S8). If the ink cartridge 2 newly installed after a replacement is the ink cartridge 2B containing large amount (FLAG 3=0) (S9: YES), FLAG 2 (the cartridge replacement flag)=1 is obtained and "1" is stored in the FLAG 2 storage area 94*d* of the EEPROM 94 in S10. Then the process proceeds to S11 for indication process for cartridge 2B.

On the other hands, if the ink cartridges 2A containing standard amount is newly installed after a replacement (FLAG 3=1) (S9:NO), FLAG 2 (the cartridge replacement flag)=2 is obtained and "2" is stored in the FLAG 2 storage area 94*d* of the EEPROM 94 in S13. Then the process proceeds to S14 for indication process for cartridge 2A.

In S7, if a replacement of the ink cartridge 2 is not conducted and the ink cartridge 2B is presently installed (S7:FLAG 2=1), it is not necessary to go through the processes of cartridge identification from S8 to S10. The process proceeds to S11 for indication process for cartridge 2B.

Moreover, in S7, if a replacement of the ink cartridge 2 is not conducted and the ink cartridge 2A is presently installed (S7:FLAG 2=2), it is also not necessary to go through the processes of cartridge identification from S8 to S13. The process proceeds to S14 for indication process for cartridge 2A.

Figure 13:
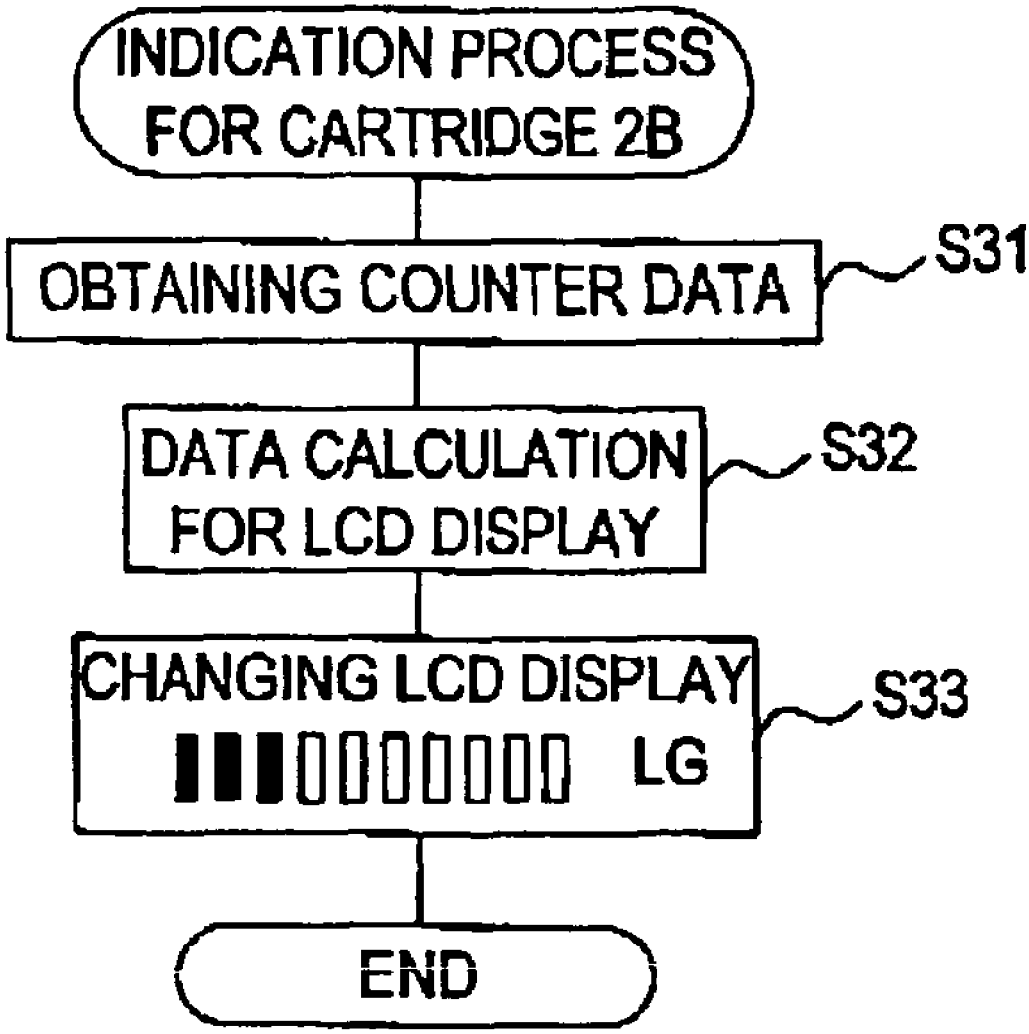
FIG. 13 is a flowchart showing indication process for cartridge containing large amount executed in the overall process shown in FIG. 9.

The following describes the identification process for cartridge 2B of S11 with a reference to FIG. 13. FIG. 13 is a flowchart showing the process of the ink-jet recording apparatus 11 wherein display of LCD of the indicator 111 indicates that an ink cartridge 2B containing large amount is installed in case the ink cartridge 2B is newly installed after a replacement, or in case a replacement of the ink cartridge 2 was not conducted but the ink cartridge 2 presently mounted is identified to be the ink cartridge 2B.

When the ink cartridge 2B containing large amount is identified in above-described cases, the count data is obtained from the first downcounter 94*a*. As described earlier, the maximum number of jetting is set in the first downcounter 94*a* when the ink cartridge 2 is replaced with the ink cartridge 2B and the number is counted down at every jetting of the ink 71 from the nozzles of the printing head 3. Hence, the amount of the ink 71 in the ink cartridge 2B can be known by obtaining the count data from the first downcounter 94*a*. Based on the obtained count data, the CPU 91 calculates the data in S32 and changes the display of the LCD of the indicator 111 according to the result of the calculation in S33. If the maximum number of jetting is 100,000 and the count presently obtained is 30,000, for example, the amount of the remaining ink 71 is 80% of the initial amount. S33 of FIG. 13 illustrates the ink cartridge 2B not yet in the near-empty status and about 80% of the ink 71 remained therein. It goes without saying that when the ink cartridge 2B is newly installed after a replacement, the maximum number of jetting for the full amount is set in the first downcoutner 94*a* and the LCD displays that the amount of the remaining ink 71 is 100%. Moreover, the LCD of the indicator 111 displays "LG (large)" since the value "1" is stored in the FLAG 2 (the cartridge identification flag) storage area 94*d* in the EEPROM 94. From this display, a user can know that an ink cartridge 2B is presently installed. After the display of the LCD is changed in S33, the operation of the inkjet recording apparatus 1 of the present embodiment shown in FIG. 9 is completed.

Figure 14:
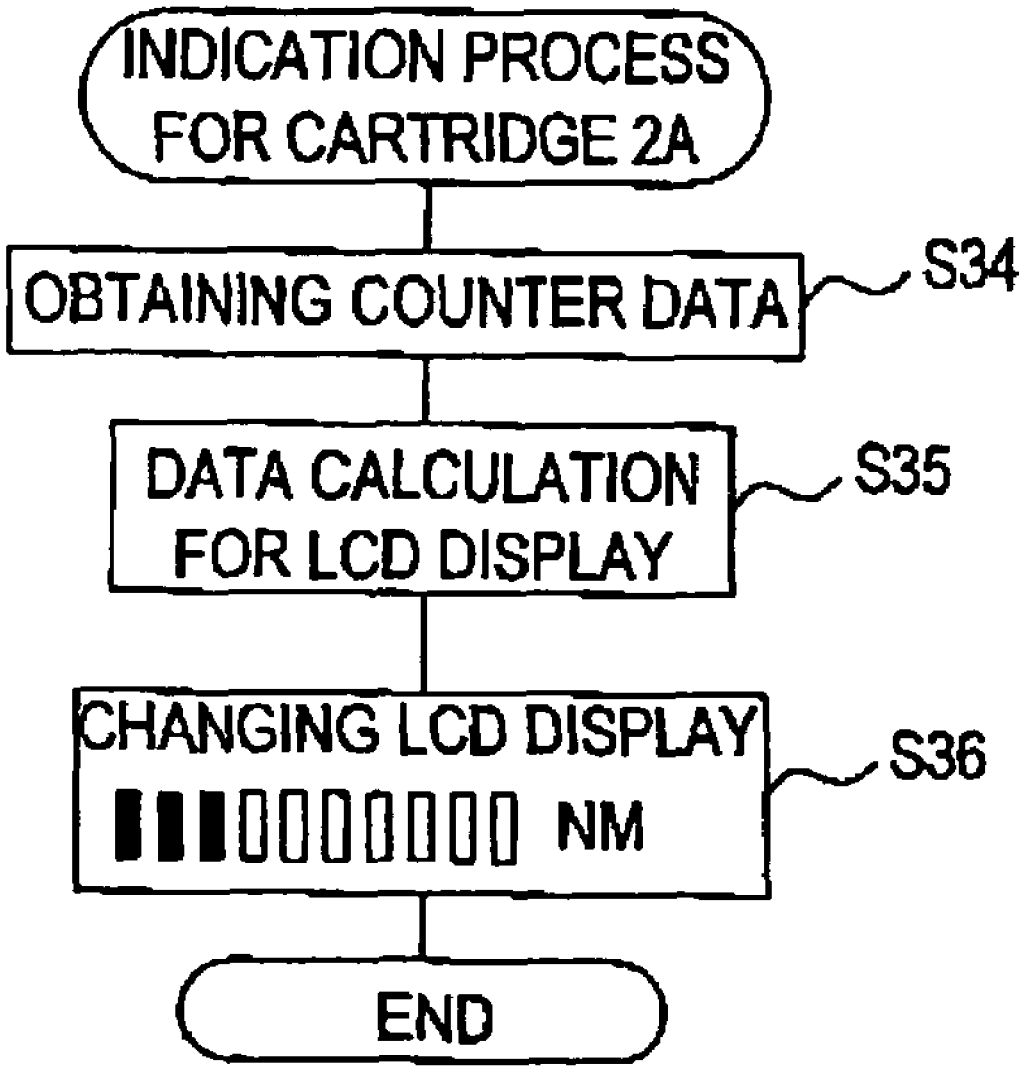
FIG. 14 is a flowchart showing indication process for cartridge containing standard amount executed in the overall process shown in FIG. 9.

The following describes the indication process for cartridge 2A in S14 with a reference to FIG. 14. FIG. 14 is a flowchart showing the process of the inkjet recording apparatus 1 wherein LCD display of the indicator 111 indicates that an ink cartridge 2A containing standard amount is installed in case the ink cartridge 2A is newly installed after a replacement, or in case a replacement of the ink cartridge 2 was not conducted but the ink cartridge 2 presently installed is identified to be the ink cartridge 2A.

When the ink cartridge 2A containing standard amount is identified in above-described cases, the count data is obtained from the first downcounter 94*a* in S34. As described earlier, the maximum number of jetting is set in the first downcounter 94*a* when the ink cartridge 2 is replaced with the ink cartridge 2A and the number is counted down at every jetting of the ink 71 from the nozzles of the printing head 3. Hence, the amount of the ink 71 in the ink cartridge 2A can be known by obtaining the count data from the first downcounter 94*a*. Based on the obtained count data, the CPU 91 calculates the data in S35 and changes the LCD display of the indicator 111 in S36. If the maximum number of jetting is 80,000 and the count presently obtained is 24,000, for example, the amount of the remaining ink 71 is 30% of the initial amount. S36 of FIG. 14 illustrates the ink cartridge 2A not yet in the near-empty status and about 30% of the ink 71 remained therein. It also goes without saying that when the ink cartridge 2A is newly installed after a replacement, the maximum number of jetting for the full amount is sent in the first downcoutner 94*a* and the LCD displays that the amount of the remaining ink 71 is 100%. Moreover, the LCD of the indicator 111 displays "NM (normal)" as the value "2" is stored in the FLAG 2 (the cartridge replacement flag) storage area 94*d* in the EEPROM 94. From this display, a user can know that the ink cartridge 2A is presently installed. After the display of the LCD is changed in S36, the operation of the inkjet recording apparatus 1 of the present embodiment shown in FIG. 9 is completed.

Figure 15:
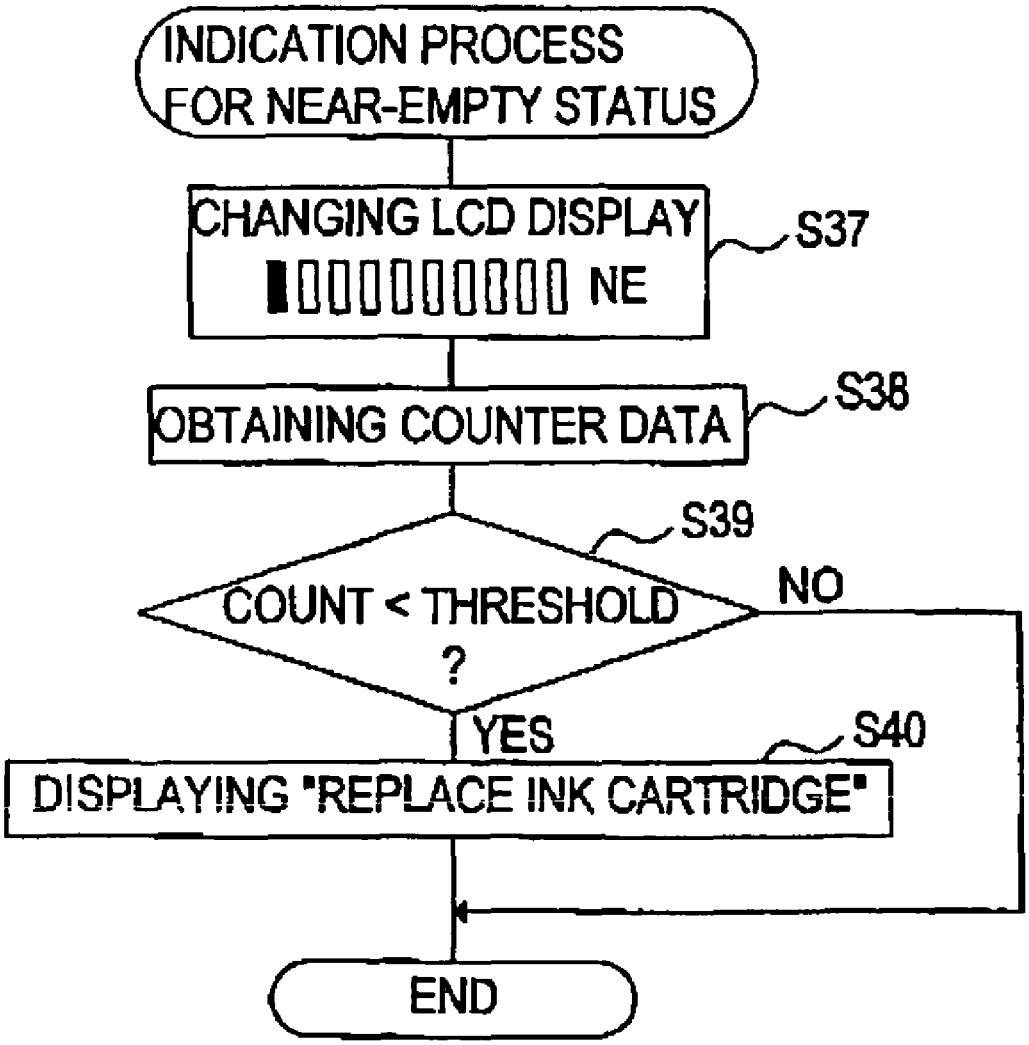
FIG. 15 is a flowchart showing indication process for near-empty status executed in the overall process shown in FIG. 9.

The following describes the indication process for near-empty status in S12 with a reference to FIG. 15. FIG. 15 is a flowchart showing the process wherein the LCD of the indicator 111 displays the indication of near-empty status when FLAG 1 (near-empty flag)=1 is obtained in S3 or S6.

When FLAG 1 (near-empty flag)=1 is obtained in S3 or S6, the display of the LCD of the indicator 111 is firstly changed to the near-empty status indication in S47. Specifically, the LCD display is changed to show that about 10% of the ink 71 is remained. Moreover, the LCD of the indicator 111 displays "NE (near-empty)" as the value "1" is stored in the FLAG 1 storage area 94*c* in the EEPROM 94. From this display, a user can know that the ink cartridge 2 is in a near-empty status. Subsequently, the count data is obtained from the first downcounter 94*a* in S38. As described earlier, the maximum number of jetting in the near-empty status is set in the first downcounter 94*a* when the ink cartridge 2 is determined to be in a near-empty status for the first time (S6:NO), and the number is counted down at every jetting of the ink 71 from the nozzles of the printing head 3. Hence, the amount of the ink 71 in the ink cartridge 2 can be known by obtaining the count data from the first downcounter 94*a*. In S39, it is determined whether or not the count obtained from the first downcounter 94*a* is smaller than predetermined value, e.g. 1,000. If the count obtained from the first downcounter 94*a* is smaller than the predetermined value (S39:YES), the display on the LCD of the indicator 111 is changed to indicate that the ink cartridge 2 needs to be replaced in S40, and then this process is completed. To the contrary, if the count obtained from the first downcounter 94*a* is larger than the predetermined value (S39:NO), this process is completed without taking any further steps.

Although no corrections on the detection positions detected by the optical sensor 19 are conducted in above embodiments, a correction process can be done to avoid detections at inappropriate positions according to the following. The detection position correction process is described in below with a reference to FIGS. 16 to 19.

Explanations of the processes listed in below are not repeated here since these processes are the same as the ones already described above and shown in FIGS. 10 to 15: the data obtaining process (S15 to S22), the near-empty determination process (S23 to S26), the cartridge identification process (S27 to S30), the indication process for cartridge 2B (S31 to S33), the indication process for cartridge 2A (S34 to S36), and indication process for near-empty status (S37 to S40).

Figure 16:
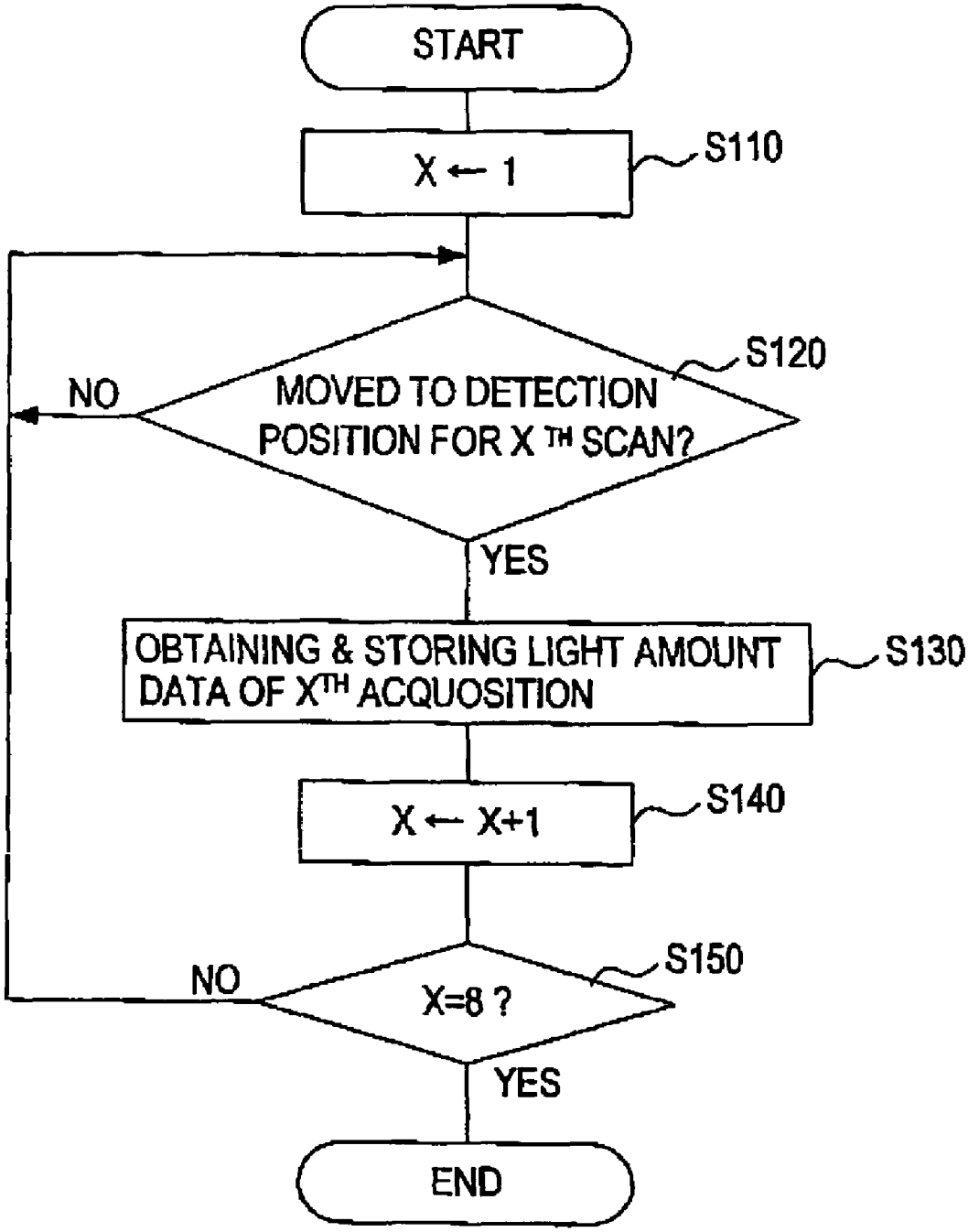
FIG. 16 is a flowchart showing a cartridge scan process in order to conduct a detection on detection target portions of an ink cartridge of the present invention with a high degree of accuracy.

The cartridge scan process in FIG. 16 is initiated when the cartridge replacement button is pressed and an opening/closing of the cover is detected while the power of the inkjet recording apparatus 1 is on. That is to say, this process is initiated when the ink cartridge 2 is replaced. In this process, the CR motor 101 is driven by the CR motor drive circuit and the carriage 5 is moved (is started to move) until the first detection target portion 82 faces the emitting direction of the light emitter 19*a* of the optical sensor 19. In this embodiment, light amount data are obtained and stored seven times as described in detail later. This number can be, needless to say, less or more than seven times. An encoder (not shown) is disposed in the CR motor 101 and the CPU 91 specifies the position of the optical sensor 19 based on signals outputted from this encoder.

In S110 of the cartridge scan process of the present embodiment, "1" is stored in a "x" storage area in the RAM 98 before the optical sensor 19 detects reflected light from the seven points (shown in FIG. 17A) in the first and detection target portions 82 and 81.

The CPU 91 stands by until the carriage 5 is moved to a predetermined detection position for "$x^{th}$" data acquisition (S120:NO). When the carriage 5 is moved to the detection position for "$x^{th}$" acquisition (S120:YES), then light is emitted from the light emitter 19*a* of the optical sensor 19 to (the first and second detection target portions 82 and 81 of) the ink cartridge 2 and a value of voltage V0 (the value of voltage becomes smaller when there is more amount of light, in the present embodiment) which indicates the amount of the light received by the light receiver 19*b* from the ink cartridge 2 is stored in the EEPROM 94 as light amount data in S130. In this light amount data, as well as a value of voltage indicating the amount of light, a coordinate value P (the value which becomes greater in the left side of the horizontal coordinate axis in FIG. 17A in the present embodiment) which indicates the detection position for "$x^{th}$" data acquisition is stored so that the coordinate value P can be specified.

After obtaining and storing light amount data from "$x^{th}$" data acquisition, "1" is added to the "x" stored in the "x" storage area in S140.

In S150, it is determined whether or not x=8. If it is not yet x=8, the process goes back to S120 to obtain light amount data from "$x^{th}$" data aqcuisition.

Figure 17A:
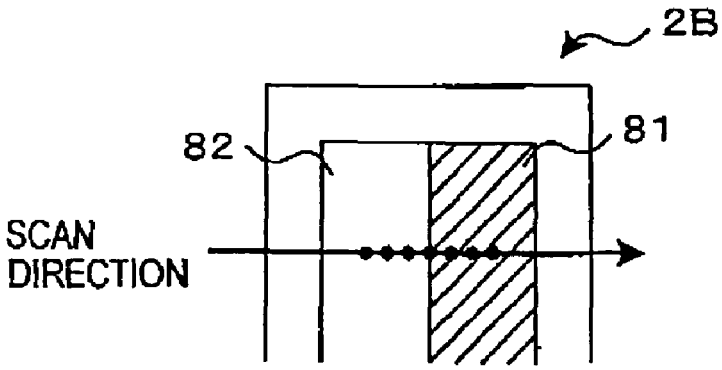
FIG. 17A is a schematic diagram showing detection position in first and second detection target portions.
Figure 17B:
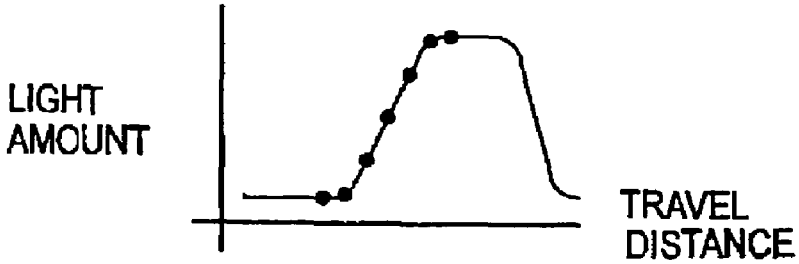
FIGS. 17B and 17C are graphs indicating the amount of light received by the optical sensor when scanning an ink cartridge and output voltage.
Figure 17C:
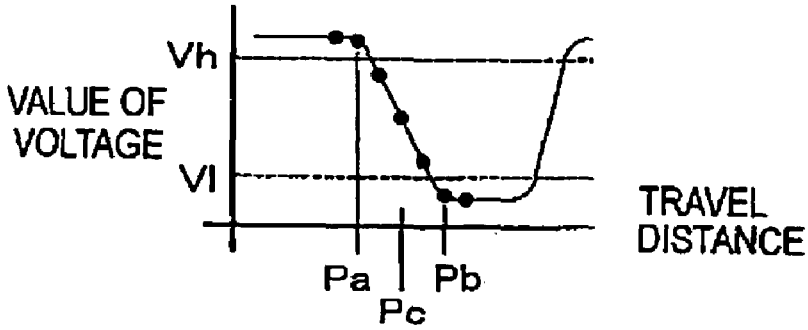

On the other hand, if it is x=8 (S150:YES), the cartridge scan process is terminated. FIG. 17B shows a graph wherein the vertical scales indicate the amount of light (light intensity) according to light amount data obtained from the first to seventh data acquisitions as above, and the horizontal scales indicate the travel distance of the optical sensor 19 in relation to the ink cartridge 2. The graph shown in FIG. 17C has vertical scales indicating values of voltage V0 and horizontal scales indicating the travel distance.

Figure 18:
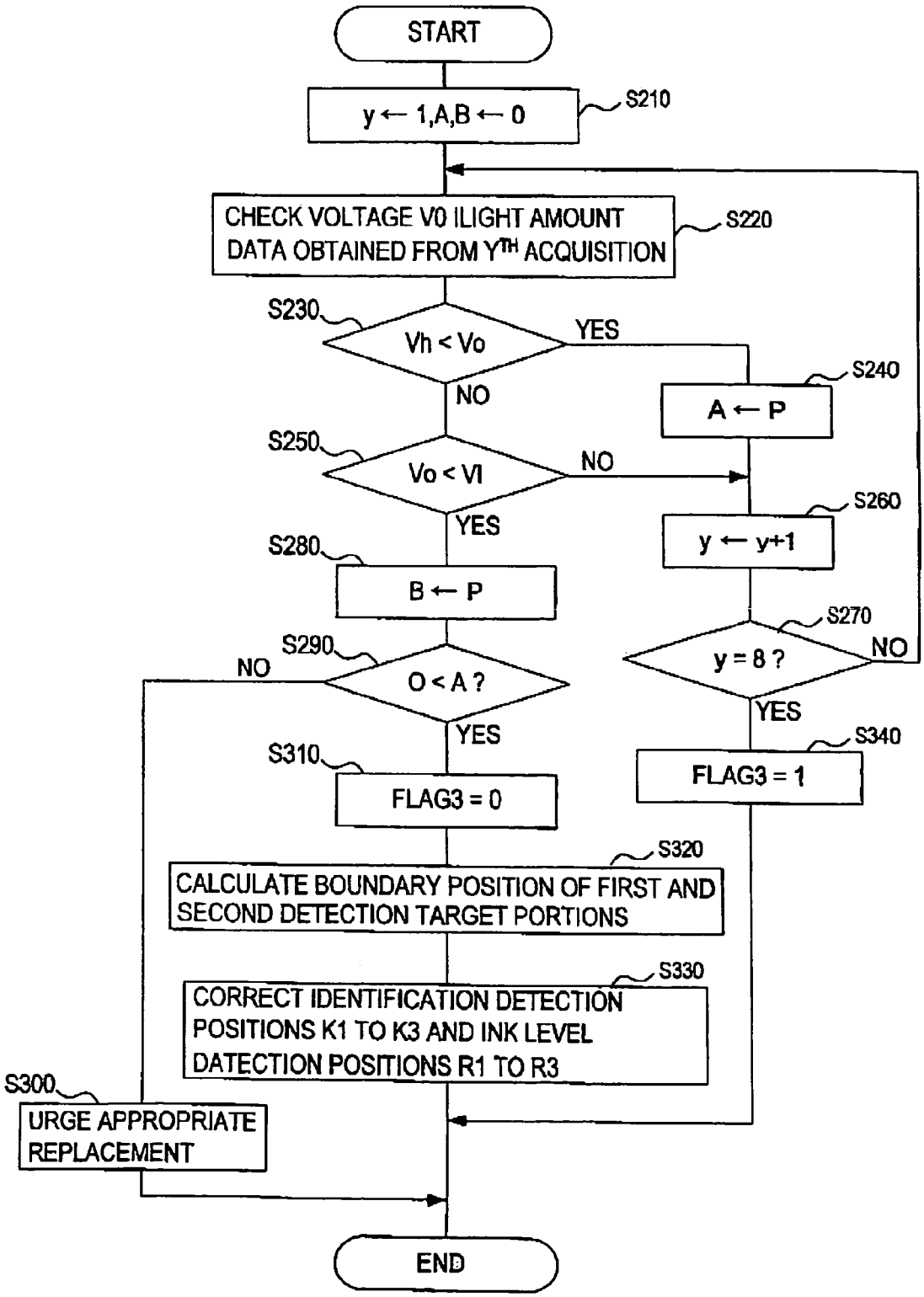
FIG. 18 is a flowchart showing detection position correction process executed after the cartridge scan process shown in FIG. 16.

When the cartridge scan process is terminated, a detection position correction process shown in the flowchart in FIG. 18 is initiated. Firstly in S210, "1" is stored in the "y" storage area of the RAM 93 and "0" is stored in the "A" and "B" storage areas.

In S220, the value of voltage V0 of the light amount data obtained from "$y^{th}$" data acquisition stored in the EEPROM 94 is checked.

In S230, the value of voltage V0 checked in the previous step is determined whether or not it is larger than a predetermined upper limit Vh. The upper limit Vh is determined to be smaller by predetermined value of voltage than the value of voltage indicating the amount of the reflected light expected to be received by the light receiver 19*b* when the light emitted from the light emitter 19*a* of the optical sensor 19 in the above cartridge scan process does not reflect on the ink cartridge 2.

If the value of voltage V0 indicated in the light amount data from "$y^{th}$" data acquisition is larger than the upper limit Vh (S230:YES), the coordinate value P specified from the light amount data obtained from "$y^{th}$" data acquisition is stored in the "A" storage area of the RAM 93 in S240.

To the contrary, if the value of voltage V0 indicated in the light amount data obtained from "$y^{th}$" data acquisition is not larger than the upper limit Vh (S230:NO), it is determined whether or not the value of voltage V0 is smaller than a predetermined lower limit Vl in S250. The lower limit Vl is predetermined to be larger by predetermined value of voltage than the value of voltage indicating the amount of the reflected light expected to be received by the light receiver 19*b* when light emitted from the light emitter 19*a* of the optical sensor 19 in the cartridge scan process reflects on the ink cartridge 2.

If the value of voltage V0 indicated in the light amount data obtained from "$y^{th}$" data acquisition is not smaller than the lower limit Vl (S250:NO), or after the process of S240, "1" is added to the "y" stored in the "y" storage area in S260.

In S270, it is determined whether or not y=8. If y=8 is not yet met, the process goes back to S220 to check the value of voltage V0 indicated in the light amount data obtained from "$y^{th}$" data acquisition.

In the above described process of S250, if the value of voltage V0 indicated in the light amount data obtained from "$y^{th}$" data acquisition is smaller than the lower limit Vl (S250:YES), the coordinate value P specified from the light amount data obtained from "$y^{th}$" data acquisition is stored in the "B" storage area in the RAM 93 in S280.

In S290, it is checked whether or not the value stored in the "A" storage area is larger than "0", that is, whether or not the coordinate P is stored in the "A" storage area.

If the value stored in the "A" storage area is not larger than "0" (S290:NO), a message to urge an appropriate replacement of ink cartridges is shown on the LCD of the indicator 111 in S300, and then the detection position correction process is terminated.

As described above, when the optical sensor 19 scans the ink cartridge 2, the optical sensor 19 moves to conduct a detection on the first detection target portion 82 and then on the second detection target portion 81. The detection position correction process is to be conducted on the premise that the ink cartridge 2 has been replaced. Thus, if the ink cartridge 2 is appropriately replaced, the light receiver 19*b* does not receive the reflected light from the first detection target portion 82 when the optical sensor 19 scans the ink cartridge 2.

However, if a user forgets to replace the ink cartridge 2 or replaces an ink cartridge 2 which does not contain enough ink therein, the reflected light from the first detection portion 82 is received by the light receiver 19*b*. In such cases, all the light amount data stored in the EEPROM 94 show smaller value of voltage than the lower limit Vl, and the process does not proceed from S230 to S240. Thus, the initial value "0" remains unchanged in the "A" storage area. In other words, by checking the value stored in the "A" storage area in S290, a cartridge replacement can be checked to assure an appropriate replacement of the ink cartridge 2.

In S300, if the value stored in the "A" storage area is larger than "0" (S300:YES), the cartridge identification flag is set to be FLAG3=0 in S310. That is, the ink cartridge 2 newly installed after a replacement is determined to be the ink cartridge 2B containing large amount and "0" is stored in the FLAGS storage area 94*e* in the EEPROM 94.

In S320, the location of the boundary between the first and second detection target portions 82 and 81 is calculated. The boundary location corresponds to the location of the coordinate value Pc which is located in the middle between the coordinate value Pa stored in the "A" storage area and the coordinate value Pb stored in the "B" storage area (i.e. Pc=(Pa+Pb)/2).

Figure 17D:
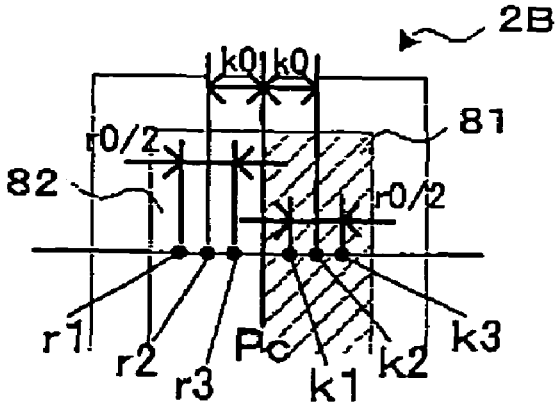
FIG. 17D is a schematic diagram showing detection positions after a correction.

Based on the boundary location calculated in S320, in S330, identification detection positions k1 to k3 at which the optical sensor 19 receives the reflected light from the second detection target portion 81, and remaining amount detection positions r1 to r3 at which the optical sensor 19 received the reflected light from the first detection target portion 82 are corrected. Both of the identification detection positions k1 to k3 and the ink level detection positions r1 to r3 are predetermined parameters used in a process which is going to be described later. As FIG. 17D shows, the second identification detection position k2 is located at predetermined distance k0 away from the boundary location to the right direction. The third identification detection position k3 is located at the half of the predetermined distance k0 away from k2 to the right direction. The first identification detection position k1 is located at the half of the predetermined distance k0 away from k2 to the left direction. The predetermined distance k0 corresponds to the half of the width (the horizontal length) of the second detection target portion 81. The position at the predetermined distance k0 away from the boundary position to the right direction is the center of the second detection target portion 81. Therefore, the reception of the reflected light from the second detection target portion 81 on the identification detection positions k1 to k3 is assured.

The second ink level detection position r2 is located at predetermined distance r0 away from the boundary position to the left direction. The third ink level detection position r3 is located at the half of the predetermined distance r0 away from r3 in the left direction. A first ink level detection position is located at the half of the predetermined distance r0 away from r2 in the right direction. The predetermined distance r0 corresponds to the half of the width (the horizontal length) of the first detection target portion 82. The position at the predetermined distance r0 away from the boundary location to the left direction is the center of the first detection target portion 82. Therefore, the reception of the reflected light from the first detection target portion 82 on ink level detection positions r1 to r3 is assured.

The identification detection position k1 to k3 constitute second detection positions. The ink level detection positions r1 to r3 constitute first detection positions.

After the process of S330 is completed, the detection position correction process is terminated.

Until y=8 is attained, the processes of S210 to S270 are repeated. When y=8 is reached (S270:YES), the process proceeds to S340, and "1" is set in the cartridge identification flag (i.e. FLAG3=1). The ink cartridge 2 newly installed after a replacement is determined to be an ink cartridge 2A and "1" is stored in the FLAG 3 storage area 94*e* in the EEPROM 94.

Y=8 attained in S270 indicates that the initial value "0" is unchanged in the "B" storage area because all the light amount data stored in the EEPROM 94 contain values of voltage V0 larger than the lower limit V1 and the process did not proceed from S250 to S280. The light amount data stored in the EEPROM 94 all contain values of voltage V0 greater than the lower limit V1 only when the light receiver 19*b* does not receive the reflection light from both of the first and second detection target portions 82 and 81 during a scan in the ink cartridge 2 conducted by the optical sensor 19.

This indicates that the light emitted from the light emitter 19*a* does not reflect even when the optical sensor 19 scans area corresponding to the position of the second detection target portion 81. The ink cartridge 2 going through a scan is identified to be an ink cartridge 2A wherein a second detection target portion 81 is not disposed. In other words, by checking the value stored in the "B" storage area in S270, the type of the ink cartridge 2 (whether or not it is an ink cartridge 2A containing standard amount) is also checked.

After the process of S340 is completed, the detection position correction process is terminated.

Figure 19:
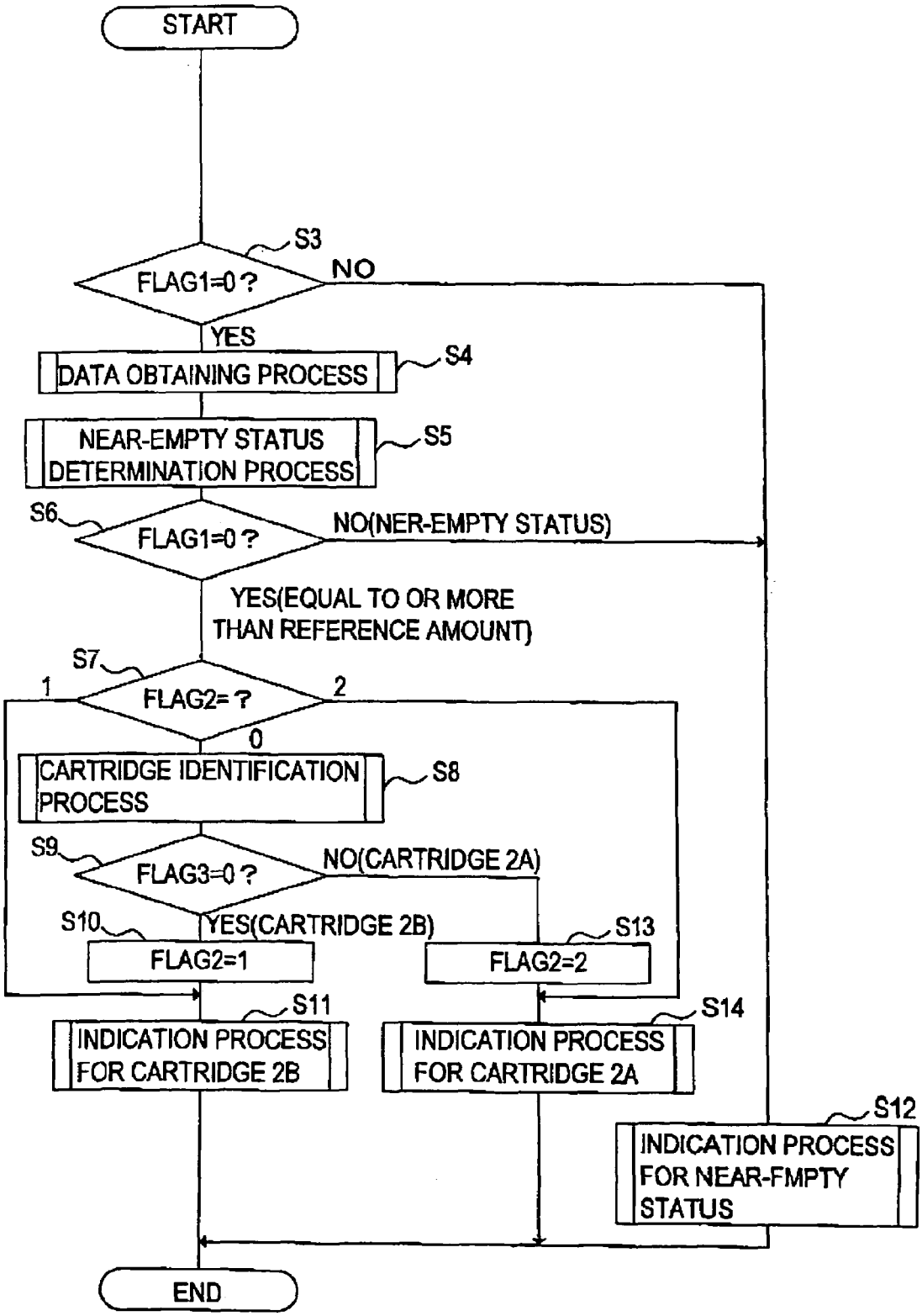
FIG. 19 is a flowchart showing the overall process of the inkjet recording apparatus in case detection positions are corrected.

The process shown in FIG. 19 is initiated at every paper feed while the power of the inkjet recording apparatus 1 is on. In S3, it is determined whether or not the FLAG 1 (the near-empty flag)=0 is obtained, that is, whether or not "0" is stored in the FLAG 1 storage area 94*c* of the EEPROM 94. If FLAG 1=1, i.e. the ink cartridge 2 is in a near-empty status (S3:NO), the process proceeds to S12 for an indication process for near-empty status which is to be described later, without obtaining and storing identification data and ink level data in S4. This is an advantage of the determination whether or not FLAG 1 (the near-empty flag)=0 conducted in S3 in this early stage of the process. In other words, if the near-empty status of the ink cartridge 2 is determined in S3, the process can proceed to the indication process for near-empty status in S12 without conducting the time-consuming process of S4.

If, on the other hand, FLAG 1=0, i.e. there is plenty of ink in the ink cartridge 2 (S3:YES), the process proceeds to S4.

In S4, a process to obtain ink level data and identification data is conducted by using the optical sensor 19. This process is carried out according to the flowchart shown in FIG. 10. Although ink level data and identification data are respectively obtained three times and stored according to this flowchart in the present embodiment, the number of data acquisition can be three or any odd number larger than three. Alternatively, the constitution can be arranged to have only one time for obtaining ink level data and identification data respectively in order to simplify the process.

In this data obtaining process, the CR motor 101 is firstly driven by the carriage motor drive circuit 102 to move the carriage 5 so that the first detection target portion 82 of the ink cartridge 2 faces the emitting direction of the light emitter 19*a* of the optical sensor 19. In the present embodiment, ink level data are obtained from three positions in the first detection target portion 82 and stored in the EEPROM 94. For "$n^{th}$" acquisition of ink level data, firstly "1" is stored in "n" storage area of the RAM 93 in S15. Then the carriage 5 is moved to the predetermined detection position rm (refer to FIG. 17D) for "$n^{th}$" data acquisition. Light is emitted from the light emitter 19*a* of the optical sensor 19 to the first detection target portion 82 (prism 52) of the installed ink cartridge 2. The light receiver 19*b* receives reflected light from the first detection target portion 82, converts the amount of reflected light into a value of voltage and outputs the value. An A/D converter 19*c* compares the value of voltage outputted from the light receiver 19*b* with predetermined value and converts the value outputted from the light receiver 19*b* into "1" or "0". The ink level data converted into "1" or "0" is stored in the EEPROM 94 in S16. As described earlier, when there is plenty of ink 71 in the ink cartridge 2, the amount of reflected light from the first detection target portion 82 is small. The value of voltage outputted by the light receiver 19*b*, in this case, is high. In the present embodiment, the predetermined value of voltage is set to be lower than the value of high voltage outputted from the light receiver 19*b*. Therefore "1" is obtained for the ink level data. On the other hand, when the ink cartridge 2 is nearly empty, the amount of reflected light from the first detection target portion 82 is large. The value of voltage outputted by the light receiver 19*b*, in this case, is low. The predetermined value of voltage is set to be higher than the value of low voltage outputted from the light receiver 19*b*. Therefore "0" is obtained for the ink level data. After first acquisition of ink level data as above, "1" is added to the "n" stored in the "n" storage area in S17. In S18, it is determined whether or not n=4. If n=4 is not obtained (S18:NO), that is, if ink level data are not yet obtained from all the three positions in the first detection target portion 82 and stored, the process goes back to S16 for "$n^{th}$" acquisition of ink level data. If n=4 (S18:YES), that is, ink level data have already been obtained from all the three positions in the first detection target portion 82 and stored in the EEPROM 94, the process proceeds to S19.

In the present embodiment, identification data are obtained from three positions in the second detection target portion 81 and stored in the EEPROM 94. For "$m^{th}$" acquisition of identification data, "1" is stored in "m" storage area of the RAM 93 in S19. Then the carriage 5 is moved to the predetermined detection position km (refer to FIG. 17D) for "$m^{th}$" data acquisition. Light is emitted from the light emitter 19*a* of the optical sensor 19 to the second detection target portion 81 (the aluminum foil 80 or the prism 52) of the installed ink cartridge 2. The light receiver 19*b* receives reflected light from the second detection target portion 81, converters the amount of reflected light into a value of voltage and outputs the value. An A/D converter 19*c* compares the value of voltage outputted from the light receiver 19*b* with predetermined value of voltage and converts the value of voltage outputted from the light receiver 19*b* into "1" or "0". The identification data converted into "1" or "0" is stored in the EEPROM 94 in S20. As described earlier, when the aluminum foil 80 is not disposed on the second detection target portion 81 and there is plenty of ink 71 in the ink cartridge 2, the amount of reflected light from the second detection target portion 81 is small. The value of voltage outputted by the light receiver 19*b*, in this case, is high. Therefore "1" is obtained for the identification data. On the other hand, when the aluminum foil 80 is disposed on the second detection target portion 81 or the ink cartridge 2 is nearly empty while the aluminum foil 80 is not disposed on the second detection target portion 81, the amount of reflected light from the second detection target portion 81 is large. The value of voltage outputted by the light receiver 19*b*, in this case, is low. Therefore "0" is obtained for the identification data. After the first acquisition of identification data as above, "1" is added to the "m" stored in the "m" storage area in S21. In S22, it is determined whether or not m=4. If m=4 is not obtained (S22:NO), that is, if identification data are not yet obtained from all the three positions in the second detection target portion 81 and stored, the process goes back to S20 for "$m^{th}$" acquisition of identification data. If m=4 (S22:YES), that is, identification data have already been obtained from all the three positions in the second detection target portion 81 and stored in the EEPROM 94, the data obtaining process is terminated and the process proceeds to S5.

Explanations of the processes listed in below are omitted here since these processes are the same as the ones already described: the near-empty determination process (S23 to S26), the cartridge identification process (S27 to S30), the indication process for cartridge 2B (S31 to S33), the indication process for cartridge 2A (S34 to S36), and indication process for near-empty status (S37 to S40).

As described above, according to the present embodiment, detection positions for detecting ink level r1 to r3 and detection positions for identification k1 to k3 can be corrected in the detection position correction process in FIG. 18 based on detection results obtained in the cartridge scan process in FIG. 16. Consequently, error detections of the optical sensor 19 on inappropriate positions can be prevented without setting the detection positions on the first and second detection target portions 82 and 81 accurately or disposing the first and second detection target portions 82 and 81 accurately, even if the area used as a first detection target portion 82 is narrower than a conventional constitution wherein a second detection target portion 81 is not disposed.

This constitution reduce the amount of time and work necessary for setting the detection position on the first and second detection target portions 82 and 81 accurately and disposing the first and second detection target portions 82 and 81 accurately. Thus the total cost of the inkjet recording apparatus 1 or the ink cartridge 2 can be reduced.

In S9 shown in FIG. 19, the type of an ink cartridge 2 can be identified by the value stored in the FLAG 3 (FLAG 3=1→ink cartridge 2A, FLAG 3=0→ink cartridge 2B). In the FLAG 3, a value, either "0" or "1", is stored (S310, S340) based on the amount of light received by the light receiver 19*b* of the optical sensor 19 in the detection position correction process in FIG. 18. It may be said that the type of an ink cartridge 2 is identified in FIG. 19 based on the amount of light received by the light receiver 19*b* of the optical sensor 19.

In S6 shown in FIG. 19, it can be determined whether or not an ink cartridge 2 is in a near-empty status corresponding to the value stored in the FALG 1 (FLAG 1=0→the remaining amount is more than the reference amount, FLAG 1=1→near-empty status). In the FLAG 1, a value, either "0" or "1" is stored (S24, S26) based on (the value of voltage indicating) the amount of light received by the light receiver 19*b* of the optical sensor 19 in the near-empty determination process in FIG. 11. It may be said that a near-empty status is determined in FIG. 19 based on the amount of light received by the light receiver 19*b* of the optical sensor 19.

In S270 shown in FIG. 18, when y=8, "1" is stored in the FLAG 3 (FLAG 3=1), and the ink cartridge 2 can be identified to be an ink cartridge 2A in S9 shown in FIG. 19. As described above, y=8 indicates that the light emitted from the light emitter 19*a* while the optical sensor 19 is scanning the first and second detection target portions 82 and 81 does not reflect, and that the state of the light reflection has not drastically changed (i.e. the value of voltage V0 that indicates the amount of light has not changed from the upper limit Vh to the lower limit Vl). Hence, it may be said that the type of the ink cartridge 2 is identified in FIG. 18 whether it is an ink cartridge 2A (no drastic change in the state of reflection) or an ink cartridge 2B (the state of reflection from the first and second detection target portions 82 and 81 changes drastically) corresponding whether or not the state of light reflection changes drastically.

In S320 shown in FIG. 18, the boundary area of the first and second detection target portion 82 and 81 can be specified based on the position of the optical sensor 19 when the amount of light received by the light receiver 19*b* changes significantly (i.e. the value of voltage V0 that indicates the amount of light changes from the upper limit Vh to the lower limit Vl) while the optical sensor 19 is scanning the first and second detection target portions 82 and 81, that is, the position where the light emitted from the light emitter 19*a* reflects for the first time.

In S330 shown in FIG. 18, the detection positions spaced from the position of the boundary in the side of the second detection target portion 81 are corrected to be identification detection positions k1 to k3, and the detection position spaced from the position of the boundary in the side of the first detection target portion 82 are corrected to be ink level detection positions r1 to r3. This correction can inhibit more assuredly the optical sensor 19 from detecting reflected light in a wrong detection target-portion.

Figure 20:
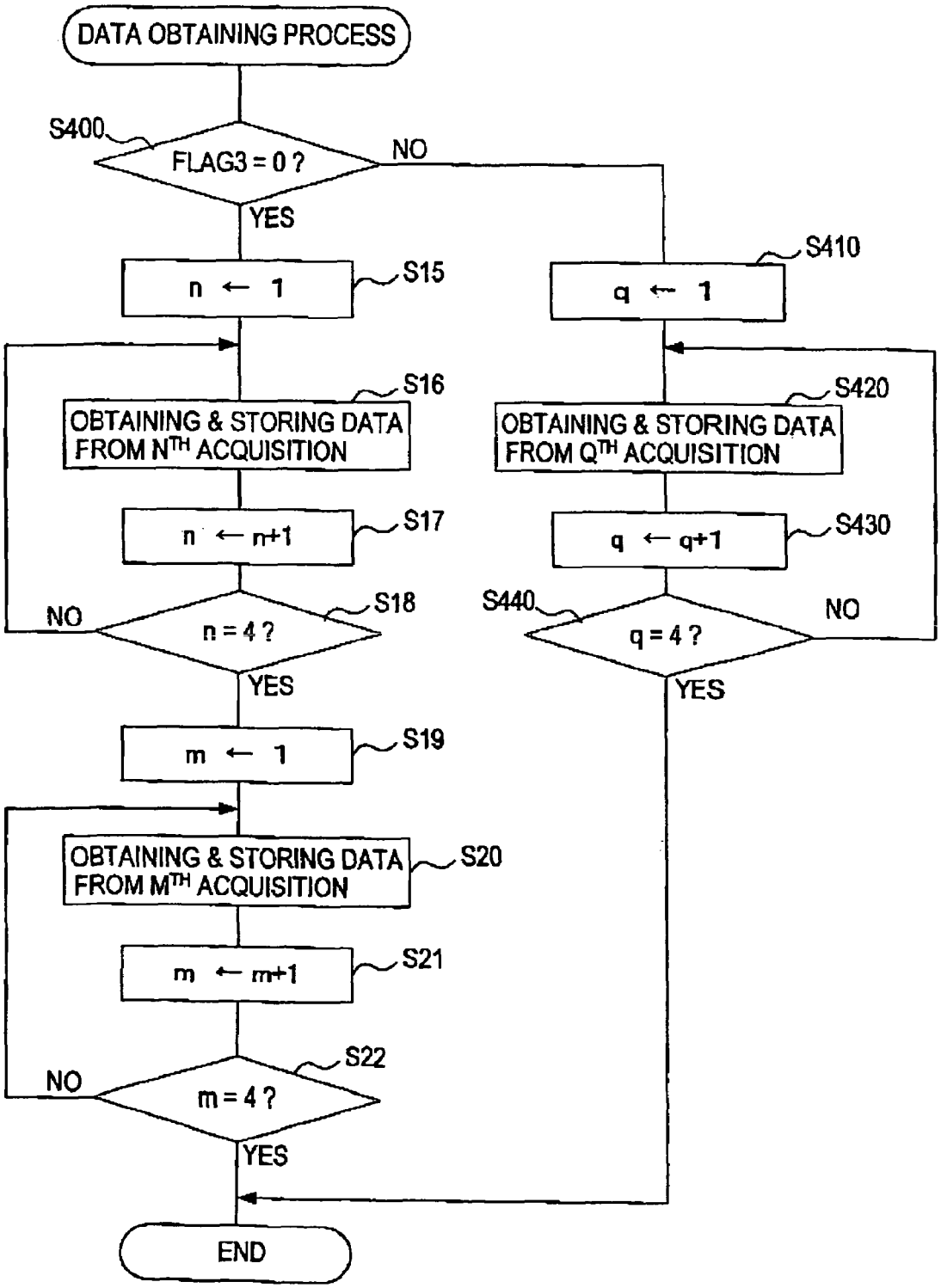
FIG. 20 is a flowchart showing a data obtaining process in another embodiment.

For an accurate ink level detection, the data obtaining process can be conducted according to the process shown in FIG. 20. If FLAG 3=0, i.e. if the ink cartridge 2 is identified to be an ink cartridge 2B containing large amount (S400: YES), the process of S15 and the process of the following steps are conducted. If, on the other hand, the ink cartridge 2 is identified to be an ink cartridge 2A containing standard amount (S400:NO), the processes described in below can be conducted.

Figure 21:
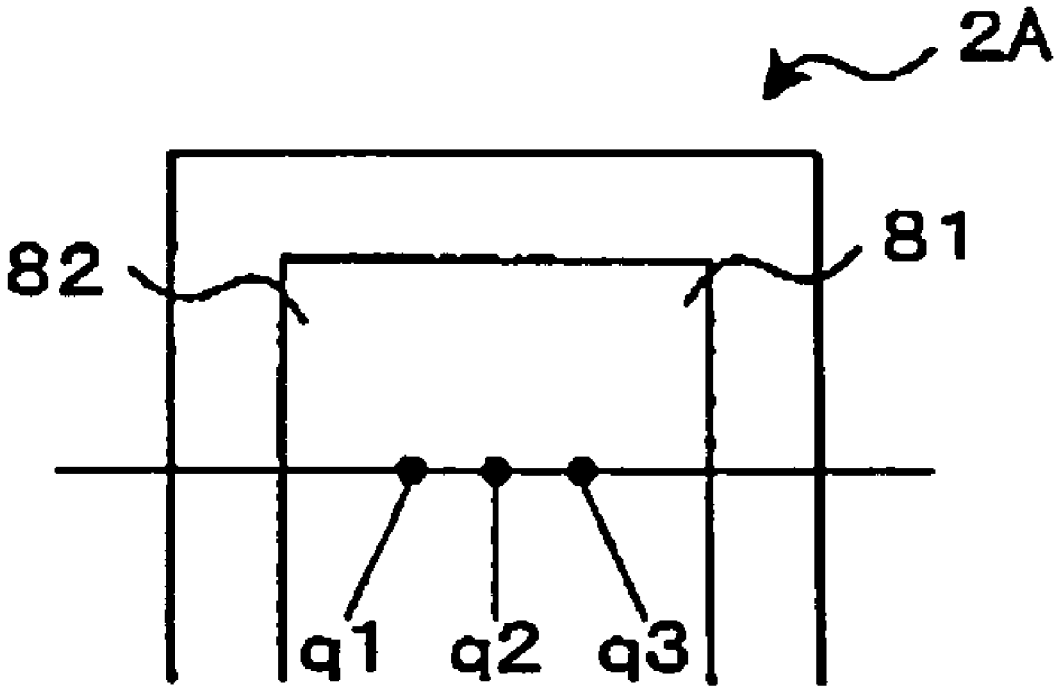
FIG. 21 is an explanatory view showing detection position for ink level detection in first to third scans in another embodiment.

Firstly in S410, "1" is stored in a "q" storage area in the RAM 93. In S420, the carriage 5 is moved to a predetermined detection position for "$q^{th}$" data acquisition. Light is emitted from the light emitter 19*a* of the optical sensor 19 to the first detection target portion 82 (of the prism 52) of an installed ink cartridge 2. The light receiver 19*b* receives reflected light from the first detection target portion 82 and the amount of the reflected light is converted to a value of voltage. The A/D converter 19*c* compares the value of voltage with a predetermined voltage, i.e. a predetermined threshold, and converts the value to either "1" or "0" based on the comparison, The ink level data in the form of "1" or "0" is stored in the EEPPROM 94. The above-mentioned detection position for "$q^{th}$" data acquisition is a detection position used if the ink cartridge 2 is identified to be an ink cartridge 2A. In the this embodiment, both of the first and second detection target portions 82 and 81 newly constitute a first detection target portion 82 as shown in FIG. 21. Almost on the center of the entire width of the new first detection target portion 82, ink level detection positions for the first to third data acquisitions (q1 to q3) disposed evenly thereon are newly set. The three ink level detection positions previously set corresponding to the coordinate value Pc can be corrected to be the ink level detection positions for the first to third data acquisitions (q1 to q3). That is, based on the position difference between the center position and the coordinate value Pc, the rest of the two positions in both sides are corrected. Subsequent to obtaining and storing the first ink level data, in S430, "1" is added to "q" stored in the "q" storage area. In S440, it is determined whether or not q=4. If "q" is smaller than 4, that is, ink level data are not yet obtained from the three detection positions in the first detection target portion 82 and not yet stored (S440:NO), the process goes back to S420 to obtain ink level data obtained from "$q^{th}$" data acquisition. Contrary, if q=4, that is, ink level data are obtained from all the three positions in the first detection target portion 82 and stored in the EEPROM 94 (S440:YES), the data obtaining process is terminated. The amount of remaining ink can be detected more precisely by newly setting detection positions almost on the center of wider first detection target portion 82 as described above.

Although only an exemplary embodiment of the present invention has been described in detail above, the present invention is not limited to the above-described embodiment, and various modifications are possible.

In the above embodiment, the second ink level detector has only one downcounter, i.e. the first downcounter 94*a*. The following explains a variation of the second ink level detector having two downcounters, i.e. the first and second downcounters 94*a* and 94*b*.

When the ink cartridge 2 is replaced, the maximum number of jetting is set in the first down counter 94*a* depending on the type of the ink cartridge 2 newly installed. On the other hand, the number of jetting for reference amount is set in the second downcounter 94*b*. Every time the ink 71 is jetted, the count only on the first downcounter 94*a* is decremented. (The count on the second downcounter 94*b* does not change.) The ink level indication indicated by the indicator 111 is changed based on the count on the first downcounter 94*a*. When a near-empty status of the ink cartridge 2 is detected by the first ink level detector, a count down on the second downcounter 94*b* is initiated. The ink level indication indicated by the indicator 111 is continued to be changed based on the count on the first downcounter 94*a*. In other words, the near-empty status detection triggers the count initiation on the second downcounter 94*b*. The second downcounter 94*b* becomes a reference to confirm whether or not the ink cartridge 2 is actually in a near-empty status when the power of the ink-jet recording apparatus 1 is turned on/off. If the count of the second downcounter 94*b* is smaller than the number of jetting for reference amount, the ink cartridge 2 is actually a near-empty status. If the count remains unchanged from the jetting number for the reference amount, the ink cartridge 2 is not yet in a near-empty status.

In the above embodiment, the reference amount is set to be equal to the amount of the ink 71 in a near-empty status. This reference amount can be changed to about 50 to 40% of the initial amount on the ink 71 by changing the sizes of the main and auxiliary ink reservoirs 44 and 45. With this constitution, the first downcounter 94*a* is reset, i.e. the maximum number of jetting for the reference amount of ink 71 is set therein when the amount of the ink 71 becomes less than the reference amount, in case the second ink level detector has only first downcounter 94*a*. A user can foresee the timing when the ink 71 runs out compared to the constitution wherein the count is continued until the amount of the ink 71 becomes the amount in a near-empty status.

Figure 22A:
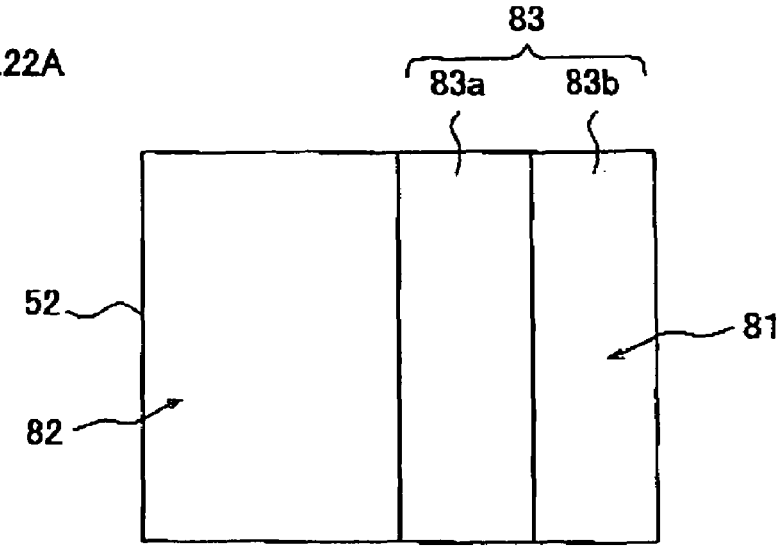
FIGS. 22A to 22C are enlarged views of the second detection target portion on which identification members for two, three and four bits are respectively attached.

Furthermore in the above embodiment, the second detection target portion 81 of the ink cartridge 2 is configured with the aluminum foil (identifying member) 80 disposed thereon so that the entire portion of the half of the prism 52 becomes reflective. Instead, an identifying member 83 for 2 bits data can be disposed as shown in FIG. 22A. The identifying member 83 is divided into two areas, 83*a* and 83*b*. These two areas are respectively made of light absorbing and reflective portions. With this constitution, two kinds of reflection are formed in each area, and four (i.e. 2×2=4) types of ink cartridges can be identified from the output voltage when the optical sensor 19 detects the second detection target portion 81.

Figure 22B:
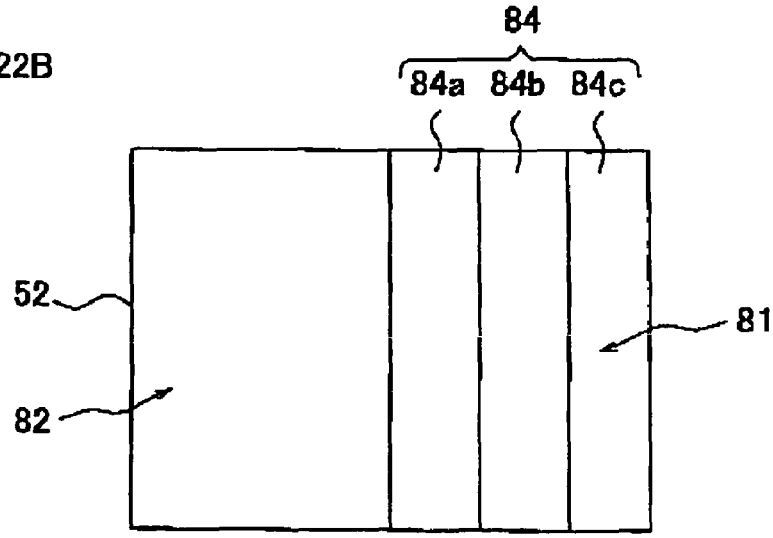

Alternatively, an identifying member 84 for 3 bits data can be disposed as shown in FIG. 22B. In this case, the identifying member 84 is divided into three areas 84*a*, 84*b* and 84*c* and constituted with light-absorbing and reflective portions. With this constitution, two kinds of reflection are formed in each area, and eight (i.e. 2×2×2=8) types of ink cartridges can be identified from the output voltage when the optical sensor 19 detects the second detection target portion 81.

Figure 22C:
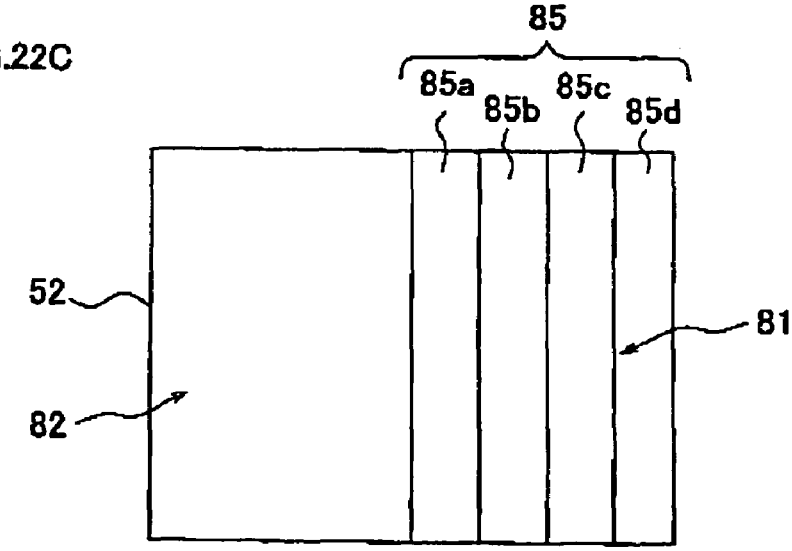

In another way, an identifying member 86 for 4 bits data can be disposed as shown in FIG. 22C. The identifying member 85 is divided into four areas 85*a* to 85*d* and constituted with light absorbing and reflective portions. As two kinds of reflection are formed in each area, sixteen (i.e. 2×2×2×2=16) types of ink cartridges can be identified from the output voltage when the optical sensor 19 detects the second detection target portion 81.

As described above, identification data can be detected with plural bits, e.g. 2, 3 or 4 bits, and more than two types, e.g. four, eight or sixteen types of ink cartridges can be identified. Although more kinds of ink cartridges can be identified if an identifying member is divided into more areas, there is a limit to the number of areas because difference in voltage output from the optical sensor 19 becomes smaller as areas become narrower. The number of detection in each area conducted by the optical sensor 19 does not necessarily have to be three times, but can be reduced to two or even one time when the dimension of each area becomes small.

The embodiment to be described in below can be applicable if more than two types of ink cartridges can be identified. For example, if there are three types of black ink cartridges containing large, standard and small amount, identification data in 2 bits should be able to identify each cartridge because up to four types of ink cartridges can be identified by identification data in 2 bits. If there are ink: cartridges containing large and standard amount of ink respectively for yellow, magenta, cyan and black colors, these eight types of ink cartridges can be all identified by identification data in 3 bits. It should be possible to identify more types of ink cartridges, if there are more colors available, by identification data in 4 bits in the present situation.

Furthermore, in the embodiments shown in FIG. 4B or FIG. 5B, if various types of ink cartridges as above should be identified, each area of the second detection target portion 81 can be constituted with light-transmissive and reflective portions and the arrangements shown in FIGS. 22A to 22C.

In the embodiment described earlier, the first downcounter 94*a* or the first and the second downcounters 94*a* and 94*b* are used as the second ink level detector. In stead of the downcounter/s, one or two upcounter/s can be used. If only one upcounter is used, the upcounter should be reset to "0" when an unused ink cartridge 2 is installed. Appropriate thresholds can be adopted depending on each type of ink cartridge 2 so that the amount of remaining ink can be indicated. When the near-empty status is detected by the first ink level detector, the ink level display of the indicator 111 is changed to a near-empty status display, the upcounter is reset to "0" and another threshold can be adopted for a reference when the ink of the reference amount runs out. When the count on the upcounter reaches beyond the threshold, a display of "replace ink cartridge" can be indicated. If two upcounters are used, both the first and the second upcounters are reset to be "0" when an unused ink cartridge is installed. At every jet of ink, only the count on the first upcounter is incremented, but not the count on the second upcounter. Appropriate threshold can be adopted in the first upcounter for ink level indication according to the type of the ink cartridge 2. The ink level indication displayed on the indicator 111 is changed based on the count on the first upcounter. When the near-empty status of the ink cartridge 2 is detected by the first ink level detector, certain number of jetting to jet out reference amount of ink is set on the first upcounter corresponding to the type of mounted ink cartridge 2, and counting up on the second upcounter is initiated. The ink level indication displayed on the indicator 111 is continued corresponding to the count on the first upcounter. Indication of "replace ink cartridge" can be displayed when the count on the second upcounter goes beyond the threshold at which the ink is supposed to run out.

Still furthermore, aluminum foil is used as an identifying member in the above-described embodiment, other reflective material, e.g. silver paper, can be used to replace the aluminum foil. The identifying member can be disposed on the ink cartridge 2A containing standard amount of ink, instead of on the ink cartridge 2B containing large amount. All such modifications are intended to be included within the scope of this invention.

What is claimed is:

1. A detection device which detects a type and ink level of an ink cartridge, the ink cartridge including a case that reserves ink therein, a first detection target portion in the case, wherein an ink level in the case can be optically detected by the detection device, and a second detection target portion on the case, wherein a type of the ink cartridge can be optically identified by the detection device, the detection device comprising:

a detector that optically detects the type the ink cartridge, and detects whether or not the ink level of the ink cartridge is equal to more than the reference amount by using the first and second detection target portions of the ink cartridge;

a transporter which moves detection positions of the detector relative to the first and second detection target portions of the ink cartridge;

a determiner which determines whether or not an amount of ink in the ink cartridge installed on the mounting portion is equal to or more than the reference amount based on a result of optical detection in the first detection target portion of the ink cartridge conducted by the detector at a first detection position, which corresponds to a position at which the first detection target portion can be detected; and an identifier which identifies the type of the ink cartridge installed on the mounting portion, based on a result of optical detection in the second detection target portion of the ink cartridge conducted by the detector at a second detection position, which corresponds to a position at which the second detection target portion can be detected.

2. The detection device as set forth in claim 1, wherein the detector comprises a light emitter which emits light toward the detection target portions of the ink cartridge, and a light receiver which receives light from the detection target portions, and wherein the identifier and the determiner respectively identify the type of ink cartridge and detect the ink level of the ink cartridge based on amount of light received by the receiver.

3. The detection device as set forth in claim 2, wherein the light receiver of the detector receives light emitted from the light emitter and reflected on the detection target portions.

4. The detection device as set forth ink claim 2, further comprising a memory storage which stores light reception signals outputted from the light receiver as light reception data when an emitting position of light from the light emitter is changed from the first detection target portion to second detection target portion, wherein the identifier and determiner respectively conduct identification and ink level detection of the ink cartridge based on the light reception data stored in the memory storage.

5. The detection device as set forth in claim 2, wherein an optical axis of the light emitter is inclined toward the first and second detection target portions, wherein the first and second detection target portions are aligned in a direction of relational movement of the light emitter and the ink cartridge, and wherein the fist detection target portion is disposed in a side wherein the optical axis of the light emitter forms an acute angle with the first detection target portion for ink level detection, and the second detection target portion is disposed on a side wherein the optical axis of the light emitter forms an obtuse angle with the second detection target portion for cartridge identification.

6. The detection device as set forth in claim 2, wherein the first and second detection target portions are aligned in a direction of relational movement of the detector and the ink cartridge, and wherein the first and second detection target portions are aligned in a manner so that the second detection target portion for cartridge identification is more distant from the light emitter than the first detection target portion for ink level detection when the light receiver detects state of light reflection in the first detection target portion for ink level detection.

7. The detection device as set forth in claim 2, wherein the first and second detection target portions are aligned, and wherein the second detection target portion for cartridge identification is disposed with an angle so as to reflect light emitted from the light emitter in a direction indirect to the detector when the light receiver detects a states of light reflection in the first detection target portion for ink level detection.

8. The detection device as set forth in claim 1, wherein the detector conducts detection at plural detection positions for detecting both the first and second detection target portions.

9. The detection device as set forth in claim 1, wherein the identifier is adapted not to identify the type of the ink cartridge, if the determiner determines that the amount of remaining ink in the ink cartridge is less than the reference amount.

10. The detection device as set forth in claim 1, wherein a state of light reflection in the first and second detection target portions is detected by the same light receiver corresponding to the relational movement of the detector and the ink cartridge.

11. The detection device as set forth in claim 1, wherein a state of light reflection in the first detection target portion is firstly detected in between the first and second detection target portions during the relational movement of the detector and the ink cartridge.

12. An image formation apparatus which forms an image on a recording medium by supplying ink provided from an ink cartridge to the recording medium, the image formation apparatus comprising:

a mounting portion capable of mounting plural types of ink cartridges initially containing different amounts of ink;

a first ink level detector comprising the detection device according to claim 1; and a second ink level detector which detects the ink level of the ink cartridge based on state of image formation on the recording medium conducted since an installation of the ink cartridge on the mounting portion, wherein the second ink level detector (a) sets an initial ink level of the ink cartridge in unused condition based on the type of the ink cartridge identified by the first ink level detector when the ink cartridge is installed on the mounting portion, (b) sets the ink level for predetermined level corresponding to the reference amount, when the ink level is detected to be lower than the ink level of the reference amount by the first ink level detector, and updates the ink level based on jets of ink from the ink head.

13. The image formation apparatus as set forth in claim 12, further comprising a display which displays the amount of ink in the ink cartridge based on the ink level detected by the second ink level detector.

14. The image formation apparatus as set forth in claim 12, wherein the second ink level detector comprises a downcounter which counts a number of jets of ink from the ink head, and wherein a count value of the downcounter is outputted as the ink level by setting a count value corresponding to the amount of ink contained in the ink cartridge as an initial value of the downcounter when the ink cartridge is installed on the mounting portion, and setting a count value corresponding to the reference amount as an initial value of the downcounter, if the ink level in the ink cartridge is detected to be lower than the ink level of the reference amount.

15. The image formation apparatus as set forth in claim 12, wherein the second ink level detector comprises:

first and second downcounters which count number of jet of ink from the ink head;

a setting unit which sets a count value corresponding to the amount of ink contained in the ink cartridge as an initial value of the first downcounter, when the ink cartridge is installed on the mounting portion, and a count value corresponding to the reference amount as an initial value of the second downcounter, when the amount of the ink in the ink cartridge is detected to be less than the reference amount; and an outputting unit which outputs the count value of the first downcounter, when the ink cartridge is installed on the mounting portion, until the amount of the ink is detected to be less than the reference amount by the first ink level detector, and the count value of the second downcounter when the amount of the ink in the ink cartridge is detected to be less than the reference amount by the first ink level detector.

16. An image formation apparatus which forms an image on a recording medium by supplying ink provided from an ink cartridge to the recording medium, the image forming apparatus comprising:

a mounting portion which is capable of mounting an ink cartridge amongst plural types of ink cartridges initially containing different amounts of ink of a same color, the ink cartridge including a first detection target portion wherein amount of ink in the ink cartridge relative to a reference amount can be detected the reference amount being less than initial amount of ink provided in each of the plural types of ink cartridge, and a second detection target portion wherein a type of the ink cartridge can be identified; and a detection device, wherein the detection device comprises:

a detector optically detects the type the ink cartridges, and detects whether or not an ink level of the ink cartridge is equal to or more than the reference amount by using the first and second detection target portions of the ink cartridge;

a transporter which changes detection positions of the detector relative to the first and second detection target portions of the ink cartridge;

a determiner which determines whether or not the amount of ink in the ink cartridge installed on the mounting portion is equal to or more than the reference amount based on a result of optical detection in the first detection target portion of the ink cartridge conducted by the detector at a first detection position, which corresponds to a position at which the first detection target portion can be detected;

an identifier which identifies the type of the ink cartridge installed on the mounting portion, based on a result of optical detection in the second detection target portion of the ink cartridge conducted by the detector at a second detection position, which corresponds to a position at which the second detection target portion can be detected.

17. The image formation apparatus as set forth in claim 16, further comprising a corrector which corrects at least the first detection position in relation to the ink cartridge installed on the mounting portion based on a detection result obtained from detection at a predetermined first detection position, and a predetermined second detection portion.

18. The image formation apparatus as set forth in claim 17, wherein the corrector sets a new boundary between the first and second detection positions, and corrects the first and second detection positions based on the boundary, if the amount of the light received by the light receiver changes equal to or more than a predetermined level, while the detector is moved by the transporter relatively so as to pass through an area including at least the first and second detection positions.

19. The image formation apparatus as set forth in claim 18, wherein the corrector corrects a position spaced out from the boundary by a predetermined distance in a first direction, which is along a passage direction of the detector when the detector passes through the area including the first and second detection positions, as the first detection position, and a position spaced out from the boundary by a predetermined distance in a second direction, which is opposite to the first direction, as the second detection position.

20. The image formation apparatus as set forth in claim 17, wherein the corrector sets a new first detection target portion constituted with the first and second detection target portions, and corrects the first detection position in the new first detection target portion, if the amount of the light received by the light receiver of the detector does not change more than the predetermined level, while the detector is moved by the transporter relatively so as to pass through the area including at least the first and second detection positions.

21. An ink cartridge check program which makes a computer system to conduct respective processes for the determiner, identifier and corrector of the image formation apparatus according to claim 17.

22. An ink cartridge check device comprising the detector, determiner, identifier, transporter, and corrector according to claim 17.

23. A correction method for correcting a detection position used in an image formation apparatus, the image formation apparatus comprising:

a mounting portion capable of mounting of an ink cartridge having a first detection target portion for determining whether or not an amount of ink reserved in an ink cartridge is more than reference amount, and a second detection target portion for identifying a type of the ink cartridge; and a detector capable of optically detecting an ink level and the type of the ink cartridge installed on the mounting portion by using the first and second detection target portions, and wherein the ink level in the ink cartridge is determined based on a result of detection conducted on the first detection target portion by the detector, and wherein the type of the ink cartridge installed on the mounting portion is identified based on a result of detection conducted on the second detection target portion by the detector, the method comprising steps of:

moving the detector relative to the ink cartridge;

conducting detection at a first detection position predetermined for the detector to be able to detect the first detection target portion of the ink cartridge;

conducting detection at a second detection position predetermined for the detector to be able to detect the second detection target portion of the ink cartridge; and correcting at least one of the first and second detection positions relative to the ink cartridge installed on the mounting portion based on results of the detection at the first and second detection positions.

* * * * *